US006613862B2

(12) United States Patent
Clark et al.

(10) Patent No.: US 6,613,862 B2
(45) **Date of Patent: *Sep. 2, 2003**

(54) TREATMENT OF FIBROUS SUBSTRATES TO IMPART REPELLENCY, STAIN RESISTANCE, AND SOIL RESISTANCE

(75) Inventors: John C. Clark, White Bear Lake, MN (US); John C. Newland, St. Paul, MN (US); Robert F. Kamrath, Mahtomedi, MN (US); Malcolm B. Burleigh, St. Paul, MN (US); Kevin R. Schaffer, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 132 days.

This patent is subject to a terminal disclaimer.

(21) Appl. No.: 09/773,860

(22) Filed: Feb. 1, 2001

(65) Prior Publication Data

US 2001/0005530 A1 Jun. 28, 2001

Related U.S. Application Data

(63) Continuation of application No. 09/070,378, filed on Apr. 30, 1998, now Pat. No. 6,197,378.

(51) Int. Cl.[7] ..... C08G 18/79

(52) U.S. Cl. ..... 528/49; 560/25; 560/118; 560/158; 106/2

(58) Field of Search ..... 560/25, 158, 118; 528/49; 106/2

(56) References Cited

U.S. PATENT DOCUMENTS

| | | | | |
|---|---|---|---|---|
| 2,876,140 A | | 3/1959 | Sheehan | 117/139.5 |
| 3,467,612 A | | 9/1969 | Gagliardi | 260/29.6 |
| 3,503,915 A | | 3/1970 | Peterson | 260/29.2 |
| 3,639,294 A | * | 2/1972 | Burns et al. | |
| 3,653,956 A | | 4/1972 | Pittman et al. | |
| 4,025,455 A | * | 5/1977 | Shackle | |
| 4,076,631 A | | 2/1978 | Caruso et al. | 252/8.8 |
| 4,107,055 A | | 8/1978 | Sukornick et al. | 252/8.6 |
| 4,144,026 A | | 3/1979 | Keller et al. | 8/115.6 |
| 4,153,561 A | | 5/1979 | Humuller et al. | 252/8.75 |
| 4,329,390 A | | 5/1982 | Danner | 428/264 |
| 4,680,212 A | | 7/1987 | Blyth et al. | 428/97 |
| 4,795,675 A | | 1/1989 | Dunn, Jr. et al. | 428/260 |
| 4,822,373 A | | 4/1989 | Olson et al. | 8/115.6 |
| 4,833,188 A | | 5/1989 | Kortmann et al. | 524/217 |
| 4,839,212 A | | 6/1989 | Blyth et al. | 428/96 |
| 4,861,501 A | | 8/1989 | Pfeifer | 252/8.6 |
| 4,875,901 A | | 10/1989 | Payet et al. | 8/115.56 |
| 4,925,707 A | | 5/1990 | Vinod | 427/393.4 |
| 4,940,757 A | | 7/1990 | Moss et al. | 525/502 |
| 4,959,248 A | | 9/1990 | Oxenrider et al. | 427/385.5 |
| 5,001,004 A | | 3/1991 | Fitzgerald et al. | 428/263 |
| 5,015,696 A | | 5/1991 | Davis et al. | 525/331.7 |
| 5,037,864 A | | 8/1991 | Anand et al. | 523/348 |
| 5,073,442 A | | 12/1991 | Knowlton et al. | 427/393.4 |
| 5,084,306 A | | 1/1992 | McLellan et al. | 427/339.4 |
| 5,240,660 A | | 8/1993 | Marshall | 264/103 |
| 5,252,232 A | | 10/1993 | Vinod | 252/8.6 |
| 5,258,458 A | | 11/1993 | Allewaert et al. | 525/104 |
| 5,310,828 A | | 5/1994 | Williams et al. | 525/502 |
| 5,385,999 A | | 1/1995 | D'Anvers et al. | 528/21 |
| 5,491,004 A | | 2/1996 | Mudge et al. | 427/393.4 |
| 5,516,337 A | | 5/1996 | Nguyen | 8/557 |
| 5,520,962 A | | 5/1996 | Jones, Jr. | 427/393.4 |
| 5,536,304 A | | 7/1996 | Coppens et al. | 252/8.57 |
| 5,554,711 A | * | 9/1996 | Traubel et al. | |
| 5,672,651 A | | 9/1997 | Smith | 524/590 |
| 5,714,082 A | | 2/1998 | Boardman et al. | 252/8.62 |
| 5,756,181 A | | 5/1998 | Wang et al. | 428/96 |
| 6,010,998 A | | 1/2000 | Merchant, Jr. et al. | 510/463 |

FOREIGN PATENT DOCUMENTS

| | | | |
|---|---|---|---|
| EP | 0 353 080 | 11/1980 | C08L/27/06 |
| EP | 0670358 A1 | 9/1993 | |
| GB | 1338430 | 10/1971 | |
| GB | 1478355 | 7/1974 | |
| WO | WO 92/10605 | 6/1992 | D06M/15/263 |
| WO | WO 93/19238 | 9/1993 | D06M/15/41 |
| WO | WO 96/18765 | 6/1996 | D08M/15/41 |
| WO | WO 97/06127 | 2/1997 | |
| WO | WO 97/11135 | 3/1997 | C09D/167/08 |
| WO | WO 97/14842 | 4/1997 | |
| WO | WO 98/03720 | 1/1998 | |
| WO | WO 98/50619 | 11/1998 | D06M/15/277 |

OTHER PUBLICATIONS

3M Scotchgard™ Carpet Protector Technical Information Manual Test (Oct. 1, 1988).

A Review of the Finishing Process, Janet Herlihy, Apr. 1994.

Standafin® FCX, Textile Chemicals DataSheet TC–0188, Henkel Corp.

* cited by examiner

*Primary Examiner*—Rachel Gorr

(57) ABSTRACT

A process is described which imparts exceptional antisoiling, anti-staining and repellent properties to carpets. The process makes use of a water-based exhaustion process wherein the water-based treating solution contains (1) glassy fluorochemical material, glassy hydrocarbon material, or combinations thereof; (2) a stainblocking material; (3) a polyvalent metal salt, acid, or combinations thereof; and (4) water. Subsequent to exhaustion, the wet treated carpet is heated, usually in a steaming step, rinsed, and dried in a dry heat oven.

20 Claims, 4 Drawing Sheets

—○— Without Mg ++
● With Mg ++, 1% SufMgSO4

TREATMENT OF FIBROUS SUBSTRATES TO IMPART REPELLENCY, STAIN RESISTANCE, AND SOIL RESISTANCE

This application is a continuation of application Ser. No. 09/070,378, filed Apr. 30, 1998 and issued as U.S. Pat. No. 6,197,378.

FIELD OF THE INVENTION

This invention relates generally to carpet treatments, and in particular to a method for imparting repellency, stain-resistance and soil-resistance to carpets by applying to the carpet an aqueous treating solution comprising a fluorochemical and/or hydrocarbon agent, a stainblocking material, and a salt.

BACKGROUND OF THE INVENTION

Various references describe methods for exhausting stainblocking materials, fluorochemicals, and/or waxes onto fibrous polyamide substrates to provide to the substrate good stain resistance to acid colorants and/or good water and oil repellency.

U.S. Pat. No. 4,875,901 (Payet et al.) discloses a method for providing fibrous polyamide substrates with stain resistance by contacting the substrate with an aqueous solution comprising a normally solid, water-soluble, partially sulfonated novolac resin and a water-soluble polyvalent metal salt.

U.S. Pat. No. 4,940,757 (Moss et al.) and its continuation-in-part, U.S. Pat. No. 5,310,828 (Williams et al.), describe polymeric compositions that impart stain resistance to polyamide fibers. The compositions are made by polymerizing an a-substituted acrylic acid or ester in the presence of a sulfonated aromatic formaldehyde condensation polymer. Optionally, this polymer can be combined with certain halogenated polymers such as perfluorinated urethanes and acrylates, and a small amount of a divalent metal salt, such as a magnesium salt, can be applied along with the stain resistant composition.

U.S. Pat. No. 4,822,373 (Olson et. al) describes treated fibrous polyamide substrates having applied thereto a partially sulfonated novolac resin and methacrylic acid-containing polymers.

U.S. Pat. No. 5,001,004 (Fitzgerald et al.) describes stain-resistant, polyamide textile substrates treated with compositions comprising hydrolyzed ethylenically unsaturated aromatic/maleic anhydride polymers. Optionally, a polyfluoroorganic oil-, water- and/or soil-repellent can be applied before, during, or after the application of the polymer. The hydrolyzed polymers can be applied to textile substrates in a variety of ways, e.g., during conventional beck and continuous dyeing processes, and are normally applied at an acidic pH.

World Published Patent Application WO 92/10605 (Pechhold) describes polyamide fibrous substrates having applied thereto (by padding, spraying, foaming, batch exhaust or continuous exhaust) a water-soluble or water-dispersible hydrolyzed or monoesterified alpha-olefin/maleic anhydride copolymer. Coapplication of a polyfluoroorganic oil-, water- and/or soil-repellent material is also disclosed.

World Patent Application No. WO 93/19238 (Pechhold) discloses a stain-resist which can be applied to polyamide textiles by padding or spraying comprising blends of maleic anhydride/alpha-olefin polymers with sulfonated phenol-formaldehyde condensation products. Optionally, a polyfluoroorganic oil-water- and/or soil-repellent can be applied before, during, or after the application of the polymer.

U.S. Pat. No. 4,925,707 (Vinod) describes the coapplication of fluorochemical anti-soilants with stainblockers to nylon carpet which is installed.

U.S. Pat. No. 5,252,232 (Vinod) describes an improved process for preparing a freeze-thaw stable aqueous composition comprising an aqueous perfluoroalkyl ester of citric acid and a hydrolyzed styrene/maleic anhydride copolymer which, when applied to an installed nylon carpet in such a way to thoroughly wet the pile fibers, imparts stain and soil resistance.

U.S. Pat. No. 5,073,442 (Knowlton et al.) describes a method for enhancing the soil- and/or stain-resistant characteristics of polyamide and wool fabrics by applying an aqueous solution containing various combinations of sulfonated phenolic compounds, compounds of sulfonated phenolics and aldehydes, fluorochemicals, modified wax emulsions, acrylics, and organic acids of low molecular weight.

U.S. Pat. No. 5,520,962 (Jones) describes a method and composition for treating carpet yarn to enhance its repellency and stain resistance by treating by immersion in an acidic aqueous medium containing an anionic or nonionic fluorochemical, heating, and removing the excess water.

U.S. Pat. No. 5,084,306 (McClellan et al.) discloses a flex nip process for coating carpets with an aqueous emulsion containing fluorochemical and polyvalent ions and/or acidifying agents.

U.S. Pat. No. 4,680,212 (Blyth et al.) describes undyed stain-resistant nylon fibers having coated on their surface one or more stainblockers and one or more fluorochemicals to impart stain resistance after trafficking. The coating is preferably applied to the nylon fibers as an aqueous spin finish during the melt spinning process used to prepare the fibers.

U.S. Pat. No. 5,516,337 (Nguyen) describes a method for improving stain resistance to fibers, especially wool, by (a) treating the fibers with a mordant, (b) treatment with a combination of sulfonated or disulfonated surfactant together with a stain resist chemical, and (c) providing treatment with a fluorochemical in either step (a) or (b) in an amount sufficient to improve stain resist properties.

European published application EP-A-797699 describes an aqueous treating composition for providing stain release properties to fibrous materials comprising (a) polymethacrylic acid [homopolymers] or copolymers containing methacrylic acid, (b) a partially sulfonated novolak resin, (c) a sulfated surfactant and (d) water, which can also contain divalent metal salts and can be coapplied with a fluorochemical composition.

U.S. Pat. No. 4,839,212 (Blyth et al.) describes nylon fibers coated with a sulfonated condensation product stainblocker and optional fluorochemical.

U.S. Pat. No. 4,959,248 (Oxenrider et al.) describes a process for imparting stain resisting properties to fibers formed from thermoplastic polymers by treating the fibers with a combination of a phenol condensation stainblocker and a fluorochemical anti-soiling agent made by reacting pyromellitic anhydride with fluorinated alcohol and an oxirane.

European Patent Application 0 353 080 (Ingham et al.) describes a process for improving the stain resistance of polyamide and keratinous fibers by treating the fibers in an aqueous dye bath at a long liquor ratio firstly with a fluorochemical composition and subsequently with a stainblocker. The reference states that the applicants found that simultaneous application results in interference between the fluorocarbon and the stainblocker.

Various fatty derivatives have been described as useful repellent and antisoiling treatments for fibrous substrates.

U.S. Pat. No. 2,876,140 (Sheehan) describes softening agents for textile materials having improved soil resistance which are a combination of barium sulfate and cationic softening agents. These softening agents are of the higher fatty acid amide type, such as the reaction products of polybasic organic acids with dialkylol substituted carbamido compounds carrying side chains containing polyamino acid radicals and their salts.

U.S. Pat. No. 4,076,631 (Caruso et al.) describes treating compositions for textiles to provide an antistatic, dirt repellent finish consisting essentially of (1) a fatty amide antistatic agent, (2) an aqueous dispersion of hard particles, such as polystyrene, polymethyl methacrylate or colloidal hydrous metal oxide, (3) a fluorine-free inorganic or organic monobasic or polybasic acid, (4) an antimicrobial agent, and (5) a fluorocarbon agent which provides a low free surface energy. At column 4, lines 37–50, treating of carpet to provide an antistatic character and resistance to dry soil (but not oily dirt) is described, though the method of treatment is not detailed U.S. Pat. No. 4,144,026 (Keller et al.) describes a process for simultaneously providing textile materials with an antistatic and dirt-repellent finish by treating the textile materials with an aqueous solution containing (a) a copolymer of an $\alpha,\beta$-unsaturated dicarboxylic acid or the anhydride thereof and at least one other ethylenically unsaturated compound, and (b) a fatty acid/alkanolamine reaction product or an alkylene oxide adduct of this reaction product, and subsequently drying them.

U.S. Pat. No. 4,153,561 (Hümüller et al.) describes storage-stable aqueous emulsions for the treatment of textiles which contain salts of N-alkyl-$\alpha$-sulfosuccinic acid amides, fatty acid amide sulfates or glycerin ether derivatives, polyethylene glycols and non-ionic dispersing agents. These emulsions can be applied to carpets of synthetic fibers in continuous pad-dyeing or printing processes, giving good wetting, and upon drying provide a soft feel and anti-soiling to the fibers.

U.S. Pat. No. 4,329,390 (Danner) describes aqueous dispersions of a microcrystalline wax, optionally together with one or more non-oxidized paraffins, having a cationic surfactant used as a dispersing agent. These aqueous dispersions, when applied to textile substrates such as carpet via impregnation or exhaust processes, provide a textile substrate with improved sewability and less damage by high-speed sewing machines.

U.S. Pat. No. 4,883,188 (Kortmann et al.) describes stable aqueous waterproofing and oil-proofing finishing agents for textiles, especially nonwoven fabrics, containing (a) compounds containing a perfluoroalkyl group (preferably acrylate (co)polymers), and (b) quaternization products of basic fatty acid amides.

U.S. Pat. No. 5,491,004 (Mudge et al) describes a method for applying a low soil finish to spun synthetic textile fibers by applying a dry, way solid component comprising a fatty bisamide, a block copolymer of ethylene oxide and propylene oxide, the reaction product of a saturated fatty alcohol, a saturated fatty amine or an ethoxylated phenol, and/or a fatty acid ester.

None of the treating compositions and methods described in the art imparts to a fibrous substrate a simultaneous combination of exceptional dynamic water and oil repellency, in-depth stain resistance, and excellent durable anti-soiling performance. These and other advantages are provided by the present invention, as hereinafter described.

SUMMARY OF THE INVENTION

In one aspect, the present invention relates to a treatment for carpets and other fibrous substrates which imparts to the substrate exceptional dynamic water and oil repellency, in-depth stain resistance, and excellent durable anti-soiling performance. In accordance with the invention, the substrate is treated with a (typically aqueous) mixture comprising (1) a repellent material selected from the group consisting of glassy fluorochemicals having a receding contact angle to n-hexadecane of greater than 53° (preferably, 65° or higher, and more preferably, at least 70° or higher) and glassy hydrocarbons having a receding contact angle to n-hexadecane of 35° or higher; (2) a stainblocking material; and (3) an exhausting aid selected from the group consisting of metal salts and acids. The aqueous mixture is typically applied by contacting the fibrous substrate with the treatment solution in such a way as to fully contact all fibers of the substrate with the solution. The wet treated substrate is then exposed to steam or other water-saturated atmosphere for a sufficient period of time, and at a sufficiently high temperature, to affix the treating materials onto the fibrous substrate. The wet treated substrate is then rinsed with water and dried in an oven at a high enough temperature to activate the materials.

In another aspect, the present invention relates to fibrous substrates treated in accordance with the method described above which exhibit excellent anti-soiling, anti-staining and repellency performance. The fibrous substrate, having had total penetration of the fluorochemical, hydrocarbon and stainblocking materials into and throughout each fiber, exhibits excellent dynamic water resistance (i.e., resistance to penetration by water-based drinks spilled from a height), greatly resists staining by aqueous acid staining agents such as red KOOL-AID™ drink, prevents oil penetration into any portion of the fiber, and in the case of carpet offers significant protection again dry soiling when compared to untreated carpet as demonstrated by several cycles of "walk-on" tests.

In another aspect, the present invention relates to a method for identifying hydrocarbon and fluorochemical materials which will exhibit good anti-soiling properties when applied to a fibrous substrate. Surprisingly, it has been found that a strong correlation exists between receding contact angle and anti-soiling properties for fluorochemical and hydrocarbon materials when they are used as carpet treatments. Consequently, receding contact angle measurements may be used to readily identify fluorochemical and hydrocarbon materials having particularly good anti-soiling properties, without having to conduct lengthy walk-on soiling tests. For the purposes of the present invention, fluorochemicals having a receding contact angle to n-hexadecane of at least about 53°, preferably greater than about 65°, and more preferably at least about 70° are found to exhibit particularly good anti-soiling properties. Similarly, hydrocarbon materials having a receding contact angle to n-hexadecane of at least about 35° are found to exhibit particularly good anti-soiling properties. When they are to be used as anti-soiling agents on carpets, it is preferred that the fluorochemical or hydrocarbon materials are hard, glassy, non-tacky, non-cationic materials having a glass transition temperature of from about 20° C. to about 130° C.

In a further aspect, the present invention relates to an immersion process for treating carpets and other fibrous substrates to improve, for example, their anti-soiling properties, wherein the treating solution comprises a material that contains both fluorochemical and hydrocarbon moieties. Substrates treated in accordance with the method exhibit excellent anti-soiling properties, but at generally greater fluorine efficiency than treatments using similar materials that lack hydrocarbon groups.

In yet another aspect, the present invention relates to an immersion process for treating carpets and other fibrous substrates to improve, for example, their anti-soiling properties, wherein the treating solution comprises a blend of fluorochemical and hydrocarbon materials. Substrates treated in accordance with the method exhibit excellent anti-soiling properties, but at generally greater fluorine efficiency than treatments using only fluorochemical materials.

In still another aspect, the present invention pertains to a method for treating carpets and other fibrous substrates with a composition comprising a hydrocarbon material and, preferably, a stainblocker. The hydrocarbon material preferably has a receding contact angle to n-hexadecane of at least about 35°. Surprisingly, substrates treated in accordance with the method are found to exhibit excellent anti-soiling properties, even when the treatment composition does not contain a fluorochemical.

DETAILED DESCRIPTION OF THE INVENTION

Figure 1:
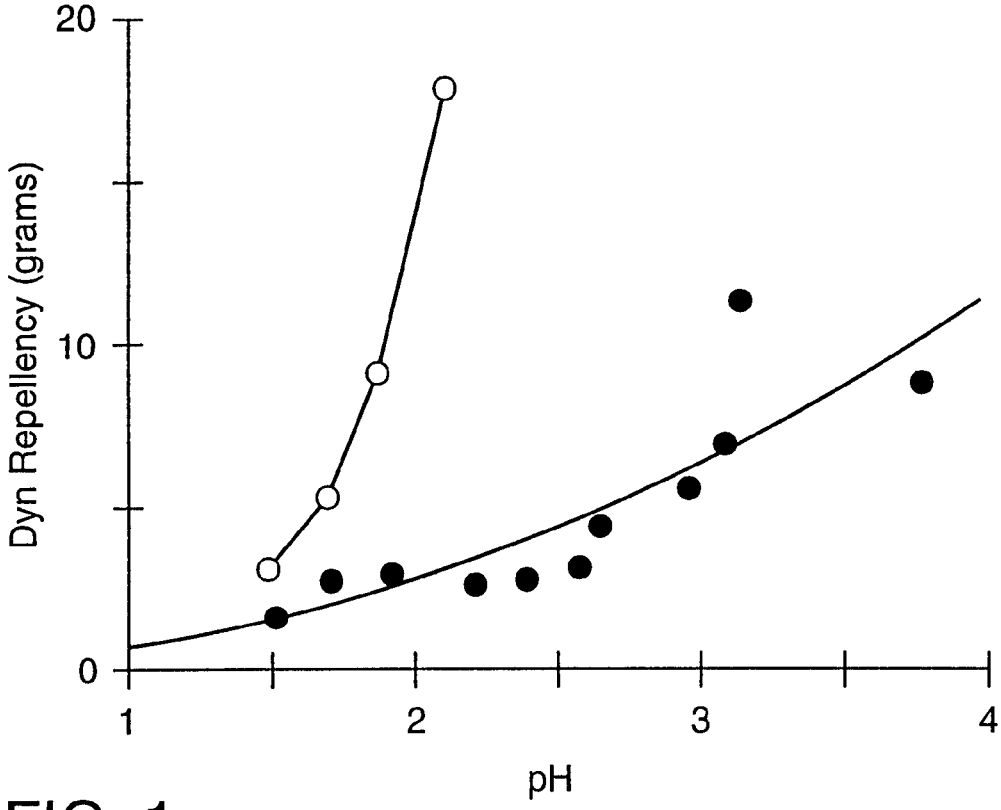
FIG. 1 is a graph of dynamic repellency as a function of pH for carpets treated in accordance with the method of the present invention.

The present invention relates to a treatment for carpets and other fibrous substrates which imparts to the substrate exceptional dynamic water and oil repellency, in-depth stain resistance, and excellent durable anti-soiling performance. In accordance with the invention, the substrate is treated with a (typically aqueous) composition comprising (1) a repellent material selected from the group consisting of glassy fluorochemicals having a receding contact angle to n-hexadecane of 65° or higher and glassy hydrocarbons having a receding contact angle to n-hexadecane of 35° or higher; (2) a stainblocking material; and (3) an exhausting aid selected from the group consisting of metal salts (preferably polyvalent metal salts) and acids. The aqueous mixture is typically applied by contacting the fibrous substrate with the treatment solution in such a way as to fully contact all fibers of the substrate with the solution. The wet treated substrate is then exposed to steam or other water-saturated atmosphere for a sufficient period of time, and at a sufficiently high temperature, to affix the treating materials onto the fibrous substrate. The wet treated substrate is then rinsed with water and dried in an oven at a high enough temperature to activate the materials.

Various exhaustion processes can be used to apply the treatment solution of the present invention to a fibrous substrate, the function of the exhaustion process being to totally contact the entirety of each fiber of the fibrous substrate with stainblocking material and the repellent fluorochemical material and/or hydrocarbon material. Examples of suitable exhaustion processes include immersion, flooding, and foam application. Useful processes and equipment include Kuster's Flexnip™ equipment, Kuster's foam applicator, Fluicon™ flood applicator, Beck vat process, Fluidye™ unit, hot otting, puddle foamer and padding. In some cases, application at a sufficient high bath temperature (e.g., over 200° F.) can eliminate the post-steaming operation.

FLUOROCHEMICAL MATERIALS

To impart oil and water repellency as well as soil resistance to a fibrous substrate, the treatments of this invention must contain certain repellent fluorochemical material and/or hydrocarbon material. Suitable fluorochemicals for use in the present invention should exhibit a receding contact angle to n-hexadecane of at least 53° or higher, preferably at least 65° or higher, and more preferably at least 70° or higher, as measured by the Receding Contact Angle Test described herein. Additionally, suitable fluorochemical-materials are hard, glassy, non-tacky, non-cationic materials having a glass transition temperature ranging from about 20° C. to about 130° C. The fluorochemical material can be from any chemical class, but fluorochemical urethanes are preferred. The fluorochemical material preferably contains a fluoroaliphatic group, and most preferably, a perfluoroaliphatic group. The concentration of fluorochemical material should be at least 0.03% SOF (solids on fiber) and preferably is at least 0.1% SOF. The following is a nonexhaustive list of fluorochemicals which are referred to in the Examples:

F-1—Scotchgard™ Fabric Protector FC-214-30—a fluorochemical acrylate/urethane commercially available as a 30% (wt) solids aqueous emulsion from Minnesota Mining and Manufacturing Company, St. Paul, Minn.

F-2—Scotchgard™ Rain and Stain Repeller FC-232—a fluorochemical acrylate/urethane, commercially available as a 30% (wt) solids aqueous emulsion from Minnesota Mining and Manufacturing Company.

F-3—Scotchgard™ Carpet Protector FC-358—a fluorochemical carbodiimide, commercially available as a 20% (wt) solids aqueous emulsion from Minnesota Mining and Manufacturing Company.

F-4—3M Brand Carpet Protector FX-364—a fluorochemical urethane, commercially available as a 23% (wt) solids aqueous emulsion from Minnesota Mining and Manufacturing Company.

F-5–3M Brand Protector FX-365—a fluorochemical urethane commercially available as a 24% (wt) solids aqueous emulsion from Minnesota Mining and Manufacturing Company.

F-6—Scotchgard™ Carpet Protector FC-1355—a fluorochemical ester, commercially available as a 45% (wt) solids aqueous emulsion from Minnesota Mining and Manufacturing Company.

F-7—Scotchgard™ Carpet Protector FC-1367F—a fluorochemical ester, commercially available as a 41% (wt) solids aqueous emulsion from Minnesota Mining and Manufacturing Company.

F-8—Scotchgard™ Carpet Protector FC-1373M—a fluorochemical urethane, commercially available as a 29% (wt) solids aqueous emulsion from Minnesota Mining and Manufacturing Company.

F-9—Scotchgard™ Carpet Protector FC-1374—a fluorochemical urethane, commercially available as a 25%

(+wt) solids aqueous emulsion from Minnesota Mining and Manufacturing Company.

F-10—Scotchgard™ Carpet Protector FC-1395—a fluorochemical urethane, commercially available as a 25% (wt) solids aqueous emulsion from Minnesota Mining and Manufacturing Company.

F-11—Duratech™ carpet treatment-believed to be a fluorochemical urethane/urea, commercially available as a 30% (wt) solids aqueous emulsion from E.I. duPont de Nemours & Co., Wilmington, Del.

F-11A—NRD-372—carpet treatment-believed to be a fluorochemical urethane/urea, commercially available as a 27% (wt) solids aqueous emulsion from E.I. duPont de Nemours & Co.

F-12—Zonylm 8779 carpet treatment-commercially available as an 11% (wt) solids aqueous emulsion from E.I. duPont de Nemours & Co.

F-13—Softech™ 97H carpet treatment-believed to be a fluoroalkyl acrylate polymer, commercially available as a 15% (wt) solids aqueous emulsion from Dyetech, Inc., Dalton, Ge.

F-14—Shawguard™ 353 fluoroalkyl acrylate copolymer-commercially available as a 13% (wt) solids aqueous emulsion from Shaw Industries, Inc.

F-15—Nuva™ FT fluorochemical acrylate polymer-commercially available as a 22% (wt) solids emulsion from Hoechst Celanese, Charlotte, N.C.

F-16—Bartex™ MAC fluorochemical-commercially available as a 14% (wt) solids emulsion from Trichromatic Carpet, Inc., Quebec, Canada F-17—Bartex™ TII fluoroalkyl acrylate polymer-commercially available as a 16% (wt) solids emulsion from Trichromatic Carpet, Inc.

F-18—MeFOSE urethane of Desmodur™ N-75

Synthesis: 368 g (0.66 eq) of MeFOSE alcohol ($C_8F_{17}SO_2N(CH_3)C_2H_4OH$) and 176 g (0.68 eq) of Desmodur™ N75 triisocyanate (a biuret isocyanate trimer derived from hexamethylene triisocyanate, commercially available from Mobay Corp., Pittsburgh, Pa.) was added along with 456 g of methyl ethyl ketone (MEK) by funnel to a 2000 mL three-necked round bottom flask fitted with stirrer and condenser. Heat was applied to the mixture using a heat lamp and agitation was started. 1 g of dibutyltin dilaurate was added, resulting in a slight exotherm, and the mixture was refluxed for 2.5 hrs. Infrared spectrum analysis of the product showed a small peak at 2310 $cm^{-4}$, indicating the presence of residual NCO in the reaction. The reaction product was poured into aluminum trays and the MEK was removed in an oven at 250° F. (121° C.). When the solvent had been removed the trays were cooled and the resultant solid urethane was placed into glass bottles.

Emulsification: 100 g of the above solid urethane was added to 250 g of methyl isobutyl ketone (MIBK), and the mixture was heated to approximately 90° C. to dissolve the urethane in the solvent. Another mixture consisting of 500 g of water and 5 g of Rhodacal™ DS-10 surfactant (commercially available from Rhone-Poulenc Corp. Cranberry, N.J.) was heated to 70° C. to dissolve the surfactant. The two liquids were mixed with stirring and were subjected to 12 minutes of emulsification using a Branson Sonifier™ Ultrasonic Horn 450 (commercially available from VVR Scientific). The solution was stripped of organic solvent on a rotary evaporator. The MIBK was co-distilled with a certain amount of water. When inspection revealed the there was no longer any odor of solvent, the amount of solids was measured and sufficient water was added to bring the final emulsion weight percent solids to 14.6%.

F-19-TG-232D fluoralkyl acrylate copolymer emulsion-available commercially from Advanced Polymers, Inc., Carlstadt, N.J.

HYDROCARBON MATERIALS

Suitable hydrocarbon materials for use in the present invention exhibit a receding contact angle to n-hexadecane of at least 35° or higher as measured by the Receding Contact Angle Test described herein. Additionally, suitable hydrocarbon materials are hard, glassy, non-tacky, non-cationic, fluorine-free materials having at least one aliphatic group and having a glass transition temperature ranging from about 20° C. to about 130° C. The aliphatic group is preferably a long-chain aliphatic group containing at least 10 carbon atoms, and more preferably containing between about 12 and about 24 carbon atoms. The hydrocarbon material can be from any chemical class, but hydrocarbon urethanes and amides are preferred. The concentration of hydrocarbon material should be at least 0.1% SOF and is preferably at least 0.2% SOF. The following is a list of hydrocarbons which are referred to in the Examples:

H-1—Octadecyl urethane of Desmodur™ N100

285 g (1.06 eq) of octadecanol and 228 g (1.12 eq) of Desmodur™ N100 triisocyanate (a biuret isocyanate trimer derived from hexamethylene triisocyanate, commercially available from Mobay Corp., Pittsburgh, Pa.) was added along with 500 g of methyl ethyl ketone (MEK) by funnel to a 2000 mL three-necked round bottom flask fitted with stirrer and condenser. Heat was applied to the mixture using a heat lamp and agitation was started. 500 mg of dibutyltin dilaurate was added, resulting in a slight exotherm, and the mixture was refluxed for 2.5 hrs. Infrared spectrum analysis of the product showed a small peak at 2310 $cm^{-1}$, indicating the presence of residual NCO in the reaction. The reaction product was poured into aluminum trays and the MEK was removed in an oven at 250° F. (121° C.). When the solvent had been removed the trays were cooled and the resultant solid urethane was placed into glass bottles.

Essentially the same emulsification procedure was followed as was described in the preparation of the emulsion for fluorochemical material F-18. The final emulsion weight percent solids was 20.0%.

H-2—Hexadecyl urethane of Desmodur™ N100—Essentially the same procedure for synthesis and emulsification was used to prepare H-2 as was used to prepare H-1 except that 272 g (1.12 eq) of hexadecanol replaced 285 g (1.06 eq) of octadecanol. The final emulsion weight percent solids was 20.0%.

H-3—Tetradecyl urethane of Desmodur™ N100—Essentially the same procedure for synthesis and emulsification was used to prepare H-3 as was used to prepare H-1 except that 256 g (1.20 eq) of tetradecanol replaced 285 g (1.06 eq) of octadecanol and 244 g (1.28 eq) rather than 228 g (1.12 eq) of Desmodur™ N100 triisocyanate was used. The final emulsion weight percent solids was 20.0%.

H-4—Dodecyl urethane of Desmodur™ N100—Essentially the same procedure for synthesis and emulsification was used to prepare H-4 as was used to prepare H-1 except that 239 g (1.28 eq) of dodecanol replaced 285 g (1.06 eq) of octadecanol and 261 g (1.37 eq) rather than 228 g (1.12 eq) of Desmodur™ N100 triisocyanate was used. The final emulsion weight percent solids was 20.0%.

H-4A—Octadecyl urethane of Desmodur™ N75—Essentially the same procedure for synthesis and emulsification was used to prepare H-4A as was used to prepare H-1 except that 284 g (1.10 eq) of Desmodur™ N75 replaced 228 g (1.12 eq) of Desmodur™ N 100 triisocyanate. The final emulsion weight percent solids was 18.0%.

H-5—Octadecyl urethane of isophorone diisocyanate-Essentially the same procedure for synthesis and emulsification was used to prepare H-5 as was used to prepare H-1 except that 348 g (1.29 eq) rather than 285 g (1.06 eq) of octadecanol was used and 152 g (1.37 eq) of isophorone diisocyanate replaced 228 g (1.12 eq) of Desmodur™ N100 triisocyanate. The final emulsion weight percent solids was 20.0%.

H-6—Hexadecyl urethane of isophorone diisocyanate-Essentially the same procedure for synthesis and emulsification was used to prepare H-5 as was used to prepare H-1 except that 336 g (1.39 eq) of hexadecanol replaced 285 g (1.06 eq) of octadecanol and 164 g (1.47 eq) of isophorone diisocyanate replaced 228 g (1.12 eq) of Desmodur™ N100 triisocyanate. The final emulsion weight percent solids was 20.0%.

H-7—Octadecyl (2 mol)/1,4-butanediol (1 mol) urethane of hexamethylene diisocyanate (2 mole)

Synthesis: 274 g (1.39 eq) of octadecanol and 164 g (1.47 eq) of hexamethylene diisocyanate were added along with 500 g of MIBK by funnel to a 2000 mL three-necked round bottom flask fitted with stirrer and condenser. Heat was applied to the mixture using a heat lamp and agitation was started. 500 g of dibutyltin dilaurate (500 mg) was added, resulting in a slight exotherm, and the mixture was refluxed for 30 minutes. At this point 48 g of butanediol was added and the mixture was refluxed for another 2 hours. Infrared spectrum analysis of the product showed a small peak at 2310 $cm^{-1}$, indicating the presence of residual NCO in the reaction. The reaction product was poured into aluminum trays and the MEK was removed in an oven at 250° F. (121° C.). When the solvent had been removed the trays were cooled and the resultant solid urethane was placed into glass bottles.

Emulsification: The same procedure was used for emulsification as was described in the preparation of Hydrocarbon Material H-1. The final emulsion weight percent solids was 20.0%.

H-8—Octadecyl (2 moles)/1,4-butanediol (1 mole) urethane of isophorone diisocyanate Into a three-necked, 2-L round bottom flask equipped with stirrer and condenser was added 210 g (4.12 eq) of isophorone diisocyanate to this was added a solution of 248 g (0.92 eq) of stearyl alcohol in 500 g of dry MEK. Heating of the mixture was commenced and 250 mg of dibutyltin dilaurate was added. The mixture exothermed, was refluxed for 1 hour, 41 g (0.92 eq) of 1,4-butanediol was added, and the mixture was refluxed for an additional 2 hours. Infrared spectroscopy run on the final mixture revealed a slight excess of isocyanate.

The mixture was poured into shallow pans in an oven for 6 hours at 125° C. The material was collected as a hard white glassy material and was emulsified as described in the preparation of Hydrocarbon Material H-1.

H-9—Hexadecyl urethane of Vestanat™ T1890 triisocyanate 75.0 g (0.071 eq) of Vestanat™ T1890 triisocyante (commercially available from Huls America, Inc., Piscataway, N.J.), 31.9 g of MEK, and 0.12 g of dibutyltin dilaurate were added to a stirred solution in a three-necked flask containing 51.9 g of hexadecanol in 50 g of MEK heated to 70° C. under nitrogen. The temperature of the mixture was increased to 78° C. over a 3 minute period, then the mixture was stirred for an additional 3.3 hours. The resulting reaction product was poured into an aluminum pan. The yield was 104.7 g (96% of theoretical).

Essentially the same emulsification procedure was used as described in the preparation of Hydrocarbon Material H-1.

H-10—Octadecyl aminoalcohol adduct of Epon™ 828 diepoxide

A one pint aluminum can was equipped with an overhead stirrer and a nitrogen purge line. The flask was charged with 152.6 g of EPON™ 828 epoxy resin (epoxy equivalent weight of 187, commercially available from Shell Chemical Co., Houston, Tex.) and 42.4 g of bisphenol A (equivalent weight of 114). The reaction was heated to 125° C. while being purged with nitrogen. Next, 5 g of bisphenol A and 0.25 g of phosphonium iodide were charged to the flask, and the reaction was heated to 145° C. The reaction exothermed to 175° C. and was held at this temperature for 1 hour. The reaction was cooled to 130° C. and 107.6 g of melted octadecylamine (equivalent weight of 269) was added to the reaction. The reaction exothermed to 163° C. and then cooled to 125° C. Finally, the reaction was heated at 125°–135° C. for 1.5 hours. The reaction was cooled to room temperature and 307 g of a glassy solid was collected.

Essentially the same emulsification procedure was used as described in the preparation of Hydrocarbon Material H-1.

H-10A —Octadecyl aminoalcohol adduct of Epon™828 diepoxide

A one pint aluminum can was equipped with an overhead stirrer and a nitrogen purge line. The flask was charged with 146 g of EPON™ 828 and 50 g of bisphenol A. The reaction was heated to 125° C. while being purged with nitrogen. Next, 4 g, of bisphenol A and 0.25 g of phosphonium iodide were charged to the flask. The reaction was heated to 145° C. The reaction exothermed to 175° C. and was held at this temperature for 1 hour. The reaction was cooled to 130° C. and 82.8 g of melted octadecylamine (equivalent weight of 269) was added to the reaction. The reaction exothermed to 163° C. and then cooled to 125° C. Finally, the reaction was heated at 125°–135° C. for 1.5 hours. The reaction was cooled to room temperature and 282 g of a glassy solid was collected.

Essentially the same emulsification procedure was used as described in the preparation of Hydrocarbon Material H-1.

H-11—Octadecyl amide of isophorone diamine

A three necked 5000 mL flask was equipped with a Dean-Stark trap and an overhead stirrer. 1854 g (6.52 mol) of stearic acid, 1.0 g of Irganox™ 245 was added to the reaction flask. The reaction flask was purged with nitrogen for 30 minutes. Next, the flask was slowly heated to 100° C., at which point all of the stearic acid had melted. 554 g (3.26 mol) of isophorone diamine was added to the reaction. The reaction was heated to 190° C. for 1 hour. There was 67 mL of water collected in the Dean-Stark trap after 1.5 hours. Next, the reaction was cooled and allowed to stand at room temperature over the weekend. Then the reaction was heated to 210° C. for one hour and then cooled. 2271 g of a white solid was collected, and its identification was confirmed an infra red and $^{13}C$ NMR spectra. The melting point was measured to be 85° C.

H-12—Azelaic diamide of isophorone diamine

A three-necked 1000 mL flask was equipped with a Dean-Stark trap and an overhead stirrer. 94 g (0.5 mol) of azelaic acid and 170 g (1.0 mol) of isophorone diamine was added to the reaction flask. Next, the flask was heated to 190° C. for 2 hours. At this point, the required amount of water (18 g) had been collected in the Dean-Stark trap. Next. 284 g (1.0 mol) of stearic acid was added to the reaction. The reaction was heated at 210° C. for 1 hour. The reaction was cooled and 500 g of a glassy solid was collected. Product identification was confirmed by an infrared spectrum.

Essentially the same emulsification procedure was used as described in the preparation of Hydrocarbon Material H-1.

H-13—Dytek/Bis-stearamide

A three necked 1000 mL flask was equipped with a Dean-Stark trap and an overhead stirrer. 284 g (1.0 mol) of stearic acid, 1.4 g of Irganox™ 245 (conmnercially available from Ciba Specialty Chemicals) was added to the reaction flask. The reaction flask was purged with nitrogen for 30 minutes. Next, the flask was slowly heated to 100° C. at which point all of the stearic acid had melted. 63 g (0.54 mol) of Dytek™ A diamine (commercially available from E.I. duPont de Nemours, Wilmington, Del.) was added to the reaction and the reaction was heated to 170–180° C. There was 9 mL of water collected in the Dean-Stark trap after 1.5 hours. Next, the reaction was heated to 200° C. and placed under vacuum (6 mm torr) for 30 minutes. The reaction was cooled and 260 g of a white solid was collected. Product identification was confirmed by an infra red spectrum, and the melting point was 110° C.

Essentially the same emulsification procedure was used as described in the preparation of Hydrocarbon Material H-1.

H-14—Octadecyl urea of Vestanat™ T1890 triisocyanate 70.0 g (0.067 eq) of Vestanat™ T1890 triisocyanate mixed with 41.6 g of toluene was added in one portion to a stirred solution of 53.8 g (0.20 eq) of Armeen™ 18D flake (stearylamine, commercially available from Akzo Nobel Corp., Chicago, Ill.) in 40.0 g of toluene heated to 60° C. under nitrogen. The temperature of the mixture was increased to 80° C. and the mixture was stirred for an additional 2.25 hours. The resulting reaction product was poured into an aluminum pan. The yield was 100.9 g (98.1% of theoretical).

Essentially the same emulsification procedure was used as described in the preparation of Hydrocarbon Material H-1.

H-15—Hexadecyl urea of Vestanat™ T1890 triisocyanate

Essentially the same procedure for synthesis and emulsification was used to prepare H-15 as was used to prepare H-14, except that 75.0 g (0.071 eq) instead of 70.0 g (0.067 eq) of Vestanat™ T1890 was used and 51.6 g (0.214 eq) of Armeen™ 16D flake (cetylamine, commercially available from Akzo Nobel Corp.) was used instead of 53.8 g (0.20 eq) of Armeen™ 18D flake.

H-17—Kenamide™ E-180—stearyl erucamide, commercially available from Witco Corp., Memphis, Tenn.

H-18—Kenamide™ E-221—erucyl erucamide, commercially available from Witco Corp., Memphis, Tenn.

H-19—Kodak™ carnauba wax flakes-commercially available from Eastman Fine Chemicals, Eastman Kodak Co., Rochester, N.Y.

H-20—Vybar™ 253 polymer (Pastille)-a highly branched hydrocarbon used as an additive to paraffin wax, commercially available from Petrolite Corp., Polymers Division, Tulsa, Okla.

H-21—Unirez™ 221—polyamide based on dimer acid commercially available from Union Camp Corp., Jacksonville, Fla.

HYBRID FLUOROCHEMICAL/ HYDROCARBON MATERIALS

In some cases, the material used in the present invention to impart oil repellency, water repellency and soil resistance to a fibrous substrate can be a hybrid of the fluorochemicals and hydrocarbons previously mentioned. Such materials may be, for example, the reaction product of a fluorochemical with a hydrocarbon material. Again, however, the resulting material must be a hard, glassy, non-tacky material having a glass transition temperature ranging from about 20° C. to about 130° C. The following is a nonexhaustive list of hybrid materials which are referred to in the Examples:

FH-1—Urethane Reaction Product of Desmodur N-75 with 75% (mol) of MeFOSE and 25% (mol) of stearyl alcohol 276 g (0.49 eq) of MeFOSE alcohol, 72 g (0.27 eq) of octadecanol and 203 g (0.78 eq) of Desmodur™ N75 triisocyanate was added along with 449 g of MIBK by funnel to a 2000 mL three-necked round bottom flask fitted with stirrer and condenser. Heat was applied to the mixture using a heat lamp and agitation was started. 1 g of dibutyltin dilaurate was added, resulting in a slight exotherm, and the mixture was refluxed for 2.5 hrs. Infrared spectrum analysis of the product showed a small peak at 2310 $cm^{-1}$, indicating the presence of residual NCO in the reaction.

Essentially the same emulsification procedure was followed as was described in the preparation of the emulsion for fluorochemical material F-18. The final emulsion weight percent solids was 15.2%.

FH-2—Urethane Reaction Product of Desmodur N-75 with 50% (mol) of MeFOSE and 50% (mol) of stearyl alcohol Essentially the same procedure for synthesis and emulsification was used to prepare FH-2 as was used to prepare FH-1, except that 184 g (0.33 eq) of MeFOSE alcohol, 144 g (0.53 eq) of octadecanol, 230 g (0.89 eq) of Desmodur™ N75 triisocyanate and 443 g of MIBK were used. The final emulsion weight percent solids was 15.3%.

FH-3—Urethane Reaction Product of Desmodur N-75 with 25% (mol) of MeFOSE and 75% (mol) of stearyl alcohol Essentially the same procedure for synthesis and emulsification was used to prepare FH-3 as was used to prepare FH-1, except that 92 g (0.16 eq) of MeFOSE alcohol. 216 g (0.80 eq) of octadecanol, 257 g (0.99 eq) of Desmodur™ N75 triisocyanate and 436 g MIBK were used. The final emulsion weight percent solids was 15.3%.

FH-4—Urethane Reaction Product of Desmodur N-75 with 10% (mol) of MeFOSE and 90% (mol) of stearyl alcohol Essentially the same procedure for synthesis and emulsification was used to prepare FH-4 as was used to prepare FH-1, except that 37 g (0.07 eq) of MeFOSE alcohol, 258 g (0.96 eq) of octadecanol, 273 g (1.05 eq) of Desmodur™ N75 triisocyanate and 432 g MIBK were used. The final emulsion weight percent solids was 15.3%.

STAINBLOCKING MATERIALS

In most embodiments, the treatment solution of the present invention will include at least one stainblocker. However, on some substrates, such as polypropylene, the stainblocker may be omitted entirely without significantly affecting oil and water repellency (see Table 14). The following is a nonexhaustive list of stainblockers which are suitable for use in the present invention, of which FX-661 is especially preferred:

S-1—3M Brand Stain Release Concentrate FX-661—a stainblocking material for carpet comprised of sulfonated phenolic and acrylic resins, commercially available from Minnesota Mining and Manufacturing Company as a 29% (wt) solids aqueous emulsion S-2—3M Brand Stain Release Concentrate FC-369—a stainblocking material for carpet comprised of sulfonated phenolic resins, commercially available from Minnesota Mining and Manufacturing Company as a 34% (wt) solids aqueous emulsion S-3—3M Brand Stain Release Concentrate FX-657—a stainblocking material for carpet comprised of modified acrylic resins, commercially available from Minnesota Mining and Manufacturing Company as a 30% (wt) solids aqueous emulsion S-4—3M Brand Stain Release Concentrate FX-670—a stainblocking material for carpet comprised of acrylic resins, commercially available from Minnesota Mining and Manufacturing Company as a 30% (wt) solids aqueous emulsion S-6—SR-300—a stainblocking material consisting of a blend of sulfonated aromatic compound and hydrolyzed copolymer of unsaturated aromatic monomer and maleic anhydride, commercially available as a 30% (wt) solids solution from E.I. duPont de Nemours & Co.

S-7—a stainblocking material which is the sodium salt of hydrolyzed styreneimaleic anhydride copolymer (SMA-1000, commercially available from Elf Atochem, Birdsboro, Pa.), which can be prepared using the procedure described in Example 1 of the U.S. Pat. No. 5,001,004 (Fitzgerald et al.).

SALTS

Various salts (e.g., metal salts) may be used in the present invention to improve the deposition of fluorochemical or hydrocarbon onto the fibrous substrate. Divalent metal salts (e.g., $MgSO_4$) are generally preferred, although good results can also be obtained under certain conditions through the use of monovalent salts or polyvalent salts. Suitable salts for use in the present invention include LiCl, NaCl, NaBr, NaI, KCl, CsCl, $Li_2SO_4$, $Na_2SO_4$, $NH_4Cl$, $(NH_4)_2SO_4$, $(CH_3)_4NCl$, $MgCl_2$, $MgSO_4$, $CaCl_2$, $Ca(CH_3COO)_2$, $SrCl_2$, $BaCl_2$, $ZnCl_2$, $ZnSO_4$, $FeSO_4$, and $CuSO_4$.

ACIDS

In some embodiments of the present invention, it will be necessary or desirable to adjust the pH of the treatment solution (e.g., by making it more acidic) so as to facilitate exhaustion of fluorochemical or other materials onto the fibrous substrate. Suitable acids that may be used in this regard include sulfuric acid, sulfamic acid, citric acid, hydrochloric acid, oxalic acid, and autoacid (a mixture of urea and sulfuric acid). While the optimal pH for the treatment solution may vary depending on the choice of materials, optimal results are generally obtained with a pH of less than about 5, and more preferably, a pH of less than about 3.

CARPETS

The following are the carpets referred to in the Examples

MO-678 Nylon 6 Carpet—off-white color, having a face weight of 38–40 oz/yd$^2$ (1.3–1.4 kg/m$^2$), commercially available from Shaw Industries, Dalton, Ga.

Wolf-Laurel Nylon 6 Carpet —white color, having a face weight of 38 oz/yd$^2$ (1.3 kg/m$^2$), commercially available from Shaw Industries.

Upbeat™ Nylon 6 Carpet —light cream color, color no. 45101, style 51145, having a face weight of 25 oz/yd$^2$ (0.9 kg/m$^2$)

Chesapeake Bay™ Polypropylene Carpet—a carpet, Style 53176, commercially available from Shaw Industries, Inc., characterized by a 100% cut pile style and a face weight of 52 oz/yd$^2$ (1.8 kg/m$^2$). The color of the carpet is Vellum and is designated by the color code 76113

Venus™ Polyester Carpet —orange carpet, commercially available from Terza Corp., Mexico

TEST METHODS

The following is a description of the test procedures referred to in the Examples and specification.

Simulated Flex-Nip Application Procedure

The Simulated Flex-Nip Application Procedure described below was used to simulate the flex-nip operations used by carpet mills to apply stainblocking composition to carpet.

In this test, a carpet sample measuring approximately 5 inches by 4 inches (13 cm×10 cm) is immersed in deionized water at room temperature until dripping wet. Water is extracted from the wet sample by spinning in a Bock Centrifuigal Extractor until the sample is damp. The damp carpet sample is then steamed for 2 minutes at atmospheric pressure, at a temperature of 90–100° C., and 100% relative humidity in an enclosed steam chamber.

After steaming, the carpet sample is allowed to cool to near room temperature, and the aqueous treating composition is applied by placing the carpet sample, carpet fiber side down, in a glass tray containing the treating composition. The treating composition contains sufficient glassy fluorochemical and/or hydrocarbon material and sufficient stainblocking material to give the desired percent solids on fiber (% SOF) and is prepared by dissolving or dispersing the two types of materials and (optionally) the desired amount of salt in deionized water and adjusting the pH to a value of 2 (unless specified otherwise) using 10% aqueous sulfamic acid. The weight of the aqueous treating solution in the glass tray is approximately 3.5 to 4 times the weight of the carpet sample. The carpet sample absorbs the entire volume of treating solution over a 1 to 2 minute period to give a percent wet pickup of 350–400%.

Then the wet treated carpet sample is steamed a second time for 2 minutes (using the same conditions and equipment as described above), is immersed briefly in a 5-gallon bucket half full of deionized water, is rinsed thoroughly under a deionized water stream to remove residual, excess treating composition, is spun to dampness using the centrifugal extractor, and is allowed to air-dry overnight at room temperature before testing.

Spray Application and Curing Procedure

The aqueous treating solution is applied to the carpet via spraying to about 15% by weight wet pickup, using a laboratory-sized spray booth with conveyor belt designed to mimic the performance of a large-scale commercial spray boom as is conventionally used in carpet mills. The wet sprayed carpet is then dried at 120° C. until dry (typically for 10–20 minutes) in a forced air oven. The application rate (in % SOF) is controlled by varying the conveyor belt speed.

Foam Application and Curing Procedure

The foamer applicator used in the present invention consists of a foam preparation device and a vacuum frame device.

The foam preparation device is a Hobart Kitchen-Aid™ mixer made by the Kitchen-Aid Division of Hobart Corporation, Troy, Ohio.

The vacuum frame device is a small stainless steel bench with a vacuum plenum and a vacuum bed. The carpet to be treated is placed on the bed, along with the foamed material to be deposited onto the carpet. The vacuum bed forms a bench that has an exhaust port fitted to a Dayton Tradesman™ 25 gallon Heavy Duty Shop Vac. The size of the bed is 8"×12"×1.5" (20 cm×30 cm×4 cm). The plenum is separated from the rest of the bed by an aluminum plate in which closely spaced 1/16" (1.7 mm) holes are drilled. The plate is similar in structure to a colander.

The portion of carpet to be treated is weighed. The carpet may then be pre-wetted with water. Several parameters of the application must be adjusted by trial and error. In particular, trial foams must be prepared in order to determine the blow ratio, which is determined by the equation blow ratio=foam volume/foam weight In general, the foam should be adjusted so that the wet pick-up of foam is about 60% that of the dry carpet weight, although other values for the wet pick-up may be employed as required for a particular application. A doctor blade can be prepared out of any thin, stiff material. Thin vinyl sheeting, approximately 100 mil (2.5 mm) thick, is especially suitable. since it can be cut easily to any size. The notch part of the blade should be about 8" (20 cm) wide so as to fit into the slot of the vacuum bed.

In a typical application, about 150 g of liquid to be foamed is put into the bowl of the Kitchen-Aid™ mixer. The wire whisk attachment is used and the mixer is set to its highest speed (10). About 2–3 minutes are allowed for the foam to form and stabilize at a certain blow ratio. The blow ratio may be calculated by placing volume marks on the side of the bowl.

An excess of the foam is placed on top of the carpet specimen resting flat on the vacuum bed. Caution must be exercised so that there are no large air pockets in the foam structure. The foam is then doctored off with the doctor blade. The vacuum is then subsequently turned on and pulled into the carpet. At this point, the carpet may be oven dried.

Treated carpet samples were subjected to the following tests considered standard in the carpet industry.

Water Repellency Test

Treated carpet samples were evaluated for water repellency using 3M Water Repellency Test V for Floorcoverings (February 1994), available from Minnesota Mining and Manufacturing Company. In this test, treated carpet samples are challenged to penetrations by blends of deionized water and isopropyl alcohol (IPA). Each blend is assigned a rating number as shown below:

| Water Repellency Rating Number | Water/IPA Blend (% by volume) |
|---|---|
| F | (fails water) |
| 0 | 100% water |
| 1 | 90/10 water/IPA |
| 2 | 80/20 water/IPA |
| 3 | 70/30 water/IPA |
| 4 | 60/40 water/IPA |
| 5 | 50/50 water/IPA |
| 6 | 40/60 water/IPA |
| 7 | 30/70 water/IPA |
| 8 | 20/80 water/IPA |
| 9 | 10/90 water/IPA |
| 10 | 100% IPA |

In running the Water Repellency Test, a treated carpet sample is placed on a flat, horizontal surface and the carpet pile is hand-brushed in the direction giving the greatest lay to the yarn. Five small drops of water or a water/IPA mixture are gently placed at points at least two inches apart on the carpet sample. If, after observing for ten seconds at a 45° angle, four of the five drops are visible as a sphere or a hemisphere, the carpet is deemed to pass the test. The reported water repellency rating corresponds to the highest numbered water or water/IPA mixture for which the treated carpet sample passes the described test.

Oil Repellency Test

Treated carpet samples were evaluated for oil repellency using 3M Oil Repellency Test III (February 1994), available from Minnesota Mining and Manufacturing Company, St. Paul, Minnesota. In this test, treated carpet samples are challenged to penetration by oil or oil mixtures of varying surface tensions. Oils and oil mixtures are given a rating corresponding to the following:

| Oil Repellency Rating Number | Oil Composition |
|---|---|
| F | (fails mineral oil) |
| 1 | mineral oil |
| 1.5 | 85/15 (vol) mineral oil/n-hexadecane |
| 2 | 65/35 (vol) mineral oil/n-hexadecane |
| 3 | n-hexadecane |
| 4 | n-tetradecane |
| 5 | n-dodecane |
| 6 | n-decane |

The Oil Repellency Test is run in the same manner as is the Water Repellency Test, with the reported oil repellency rating corresponding to the highest oil or oil mixture for which the treated carpet sample passes the test.

Dynamic Water Resistance Test

Dynamic water resistance was determined using the following test procedure. A treated carpet sample (15.2 cm×15.2 cm) is inclined at an angle of 45° from horizontal and 20 mL of deionized water is impinged onto the center of the carpet sample through a glass tube with 5 mm inside diameter positioned 45.7 cm above the test sample. The increase in weight (g) of the test sample is measured, with lower weight gains indicating better dynamic water repellency properties.

Staining Test

Stain resistance was determined using the following test procedure. A treated 13 cm×10 cm carpet sample is stained for 2 minutes by immersing the carpet sample in an aqueous solution of 0.007% (wt) of Red Dye FD&C #40 in deionized water adjusted to a pH of 2.8 with 10% aqueous sulfamic acid. The dye solution is warmed to a temperature of 55–70° C. The treated and stained carpet sample is then immersed briefly in a 5-gallon bucket half full of deionized water, followed by rinsing under a stream of deionized water until the water runs clear. The wet carpet sample is then extracted to dampness using a Bock Centrifugal Extractor and is air-dried overnight at room temperature.

The degree of staining of the carpet sample is determined numerically by using a Minolta 310 Chroma Meter™ compact tristimulus color analyzer. The color analyzer measures red stain color autochromatically on the red-green color coordinate as a "delta a" (Δa) value as compared to the color of an unstained and untreated carpet sample. Measurements reported in the tables below are given to one place following the decimal point and represent the average of 3 measurements, unless stated otherwise. A greater Δa reading indicates a greater amount of staining from the red dye. Δa readings typically vary from 0 (no staining) to 50 (severe staining).

"Walk-On" Soiling Test

The relative soiling potential of each treatment was determined by challenging both treated and untreated (control) carpet samples under defined "walk-on" soiling test conditions and comparing their relative soiling levels. The test is conducted by mounting treated and untreated carpet squares on particle board. placing the samples on the floor of one of two chosen commercial locations, and allowing the samples to be soiled by normal foot traffic. The amount of foot traffic in each of these areas is monitored, and the position of each sample within a given location is changed daily using a pattern designed to minimize the effects of position and orientation upon soiling.

Following a specific soil challenge period, measured in number of cycles where one cycles equals approximately 10,000 foot-traffics, the treated samples are removed and the amount of soil present on a given sample is determined using colorimetric measurements, making the assumption that the amount of soil on a given sample is directly proportional to the difference in color between the unsoiled sample and the corresponding sample after soiling. The three CIE L*a*b* color coordinates of the unsoiled and subsequently soiled samples are measured using a Minolta 310 Chroma Meter with a D65 illumination source. The color difference value, ΔE, is calculated using the equation shown below:

$$\Delta E[(\Delta L^*)^2+(\Delta a^*)^2+(\Delta b^*)^2]^{1/2}$$

where:

ΔL*=L*soiled−L*unsoiled

Δa*=a*soiled−a*unsoiled

Δb*=b*soiled−b*unsoiled

ΔE values calculated from these colorometric measurements have been shown to be qualitatively in agreement with values from older, visual evaluations such as the soiling evaluation suggested by the AATCC, and have the additional advantages of higher precision, being unaffected by evaluation environment or subjective operator differences. Final ΔE values for each sample are calculated as an average of between five and seven replicates.

Receding Contact Angle Test

The Receding Contact Angle Test provides a quick and precise prediction of the anti-soiling potential of treated nylon carpet. Receding contact angle values measured with n-hexadecane using this test have correlated well with anti-soiling values measured from actual foot traffic using the "Walk-On" Soiling Test.

To run this test, a solution, emulsion, or suspension (typically at about 3% solids) is applied to nylon film by dip-coating. The nylon film is prepared as follows. Nylon film is cut into 85 mm×13 mm rectangular strips. Each strip is cleaned by dipping into methyl alcohol, wiping with a Kimwipe™ wiper (commercially available from Kimberly Clark Corp., Boswell, Ga.), taking care not to touch the strip's surface, and allowing the strip to dry for 15 minutes. Then, using a small binder clip to hold one end of the strip, the strip is immersed in the treating solution, and the strip is then withdrawn slowly and smoothly from the solution. The coated film strip is tilted to allow any solution run-off to accumulate at the corner of the strip, and a Kimwipe™ tissue is touched to the corner to pull away the solution buildup. The coated film strip is allowed to air dry in a protected location for a minimum of 30 minutes and then is cured for 10 minutes at 121° C.

After the treatment is dry and cured, a drop of n-hexadecane is applied to the treated film and the receding contact angle of the drop of is measured using a CAHN Dynamic Contact Angle Analyzer, Model DCA 322 (a Wilhelmy balance apparatus equipped with a computer for control and data processing, commercially available from ATI, Madison, Wis.). The CAHN Dynamic Contact Angle Analyzer is calibrated using a 500 mg weight. An alligator clip is fastened to a piece of coated film strip about 30 mm long, and the clip and film piece are hung from the stirrup of the balance. A 30 mL glass beaker containing approximately 25 mL of n-hexadecane is placed under the balance stirrup, and the beaker is positioned so that the coated film strip is centered over the beaker and its contents but not touching the walls of the beaker. Using the lever on the left side of the apparatus, the platform supporting the beaker is carefully raised until the surface of n-hexadecane is 2–3 mm from the lower edge of the film strip. The door to the apparatus is closed, the "Configure" option is chosen from the "Initialize" menu of the computer, the "Automatic" option is chosen from the "Experiment" menu, and the computer program then calculates the time for a total of 3 scans. The result should be a time interval of 1 second and estimated total time of 5 minutes, which are the acceptable settings to show the baseline weight of the sample. The Return Key is then pressed to begin the automatic measurement cycle. 10 readings of the baseline are taken before the scan begins. The apparatus then raises and lowers the liquid so that 3 scans are taken. The "Least Squares" option is then selected from the "Analysis" menu, and the average receding contact angle is calculated from the 3 scans of the film sample. The 95% confidence interval for the average of the 3 scans is typically about ±1.20.

Fluorine Analysis Combustion Test

This test procedure, used to measure the amount of fluorochemical is presented on a treated carpet, is described in the 3M Scotchgard™ Carpet Protector Technical Information Manual Test, published Oct. 1, 1988.

EXAMPLES 1–3 AND COMPARATIVE EXAMPLES C1–C11

This series of experiments was run to determine what, if any, correlation exists between receding contact angle and anti-soiling properties for hydrocarbon materials used as carpet treatments. The receding contact angle of several hydrocarbon materials were measured using the Receding Contact Angle Test. Then, using the Simulated Flex-Nip Application Procedure, a treating solution was applied to Wolf-Laurel nylon 6 carpet to give 0.25% SOF of each hydrocarbon material, 0.6% SOF of S-1 Stainblocking Material and 1.0% SOF of $MgSO_4$ (with pH adjusted to 1.5 using 1.5% aqueous sulfamic acid). Resistance to soiling of the treated carpet samples compared to unsoiled, untrafficked carpet samples was determined using two cycles of the "Walk-On" Soiling Test. "Walk-on" soiling values and receding contact angle (RCA) values for the various hydrocarbon materials are presented in Table 1. Also presented in Table 1 are repellencies measured for the treated carpets using the Water Repellency Test, the Oil Repellency Test, and the Dynamic Water Repellency Test.

TABLE 1

| Ex. | Hydrocarbon Material | RCA, (°) | Soiling, ΔE | Water Rep. | Oil Rep. | Dyn. W. Rep. |
|---|---|---|---|---|---|---|
| 1 | H-1 | 45 | 11.5 | 1 | F | 3.7 |
| 2 | H-3 | 45 | 12.3 | 1 | F | 5.0 |
| 3 | H-10 | 40 | 14.3 | 0 | F | 10.4 |
| C1 | H-11 | 0 | 13.4 | 1 | F | 3.6 |

TABLE 1-continued

| Ex. | Hydrocarbon Material | RCA, (°) | Soiling, ΔE | Water Rep. | Oil Rep. | Dyn. W. Rep. |
|---|---|---|---|---|---|---|
| C2 | H-4 | 0 | 14.8 | 1 | F | 4.6 |
| C3 | H-16 | 0 | 15.0 | 0 | F | 2.8 |
| C4 | H-8 | 0 | 15.1 | 1 | F | 6.7 |
| C5 | H-19 | 0 | 15.3 | 0 | F | 5.9 |
| C6 | H-17 | 0 | 15.6 | 0 | F | 4.3 |
| C7 | H-5 | 0 | 16.0 | 1 | F | 6.2 |
| C8 | H-14 | 0 | 16.2 | 0 | F | 10.8 |
| C9 | H-18 | 0 | 16.7 | 0 | F | 4.4 |
| C10 | H-20 | 0 | 16.7 | 0 | F | 4.8 |
| C11 | H-21 | 0 | 16.8 | 0 | F | 7.4 |

The data in Table 1 show that the hydrocarbon materials exhibiting a receding contact angle of at least 40° showed excellent "walk-on" soil resistance, and that receding contact angle surprisingly was an excellent predictor for anti-soiling performance. Water repellency and dynamic water repellency did not correlate with receding contact angle, and oil repellency was poor in all cases.

EXAMPLES 4–10 AND COMPARATIVE EXAMPLES C12–C17

A study was made to determine whether or not fluorochemical materials show a similar correlation between anti-soiling performance and receding contact angle as shown by the hydrocarbon materials of Table 1. Receding contact angles for the fluorochemical materials were measured using-the Receding Contact Angle Test. Then, using the Flex-Nip Application Procedure, 0.25% SOF of each fluorochemical material was coapplied with 0.6% SOF of S-1 Stainblocking Material and 1.0% SOF of $MgSO_4$ from an acidic aqueous bath to samples of Style MO678 nylon 6 carpet. In addition to the "Walk-On" Soiling Test, the Water Repellency Test, Oil Repellency Test and Dynamic Water Repellency Test were also run on each treated carpet sample. Results of these evaluations are presented in Table 2.

TABLE 2

| Ex. | Fluorochemical Material | RCA, (°)[1] | Soiling, ΔE | Water Rep. | Oil Rep. | Dyn. W. Rep. |
|---|---|---|---|---|---|---|
| 4 | F-8 (Lot 30001) | 78 | 12.1 | 5 | 4 | 2.8 |
| 5 | F-8 (Lot 531) | 76 | 11.7 | 5 | 4 | 1.4 |
| 6 | F-10 | 76 | 12.8 | 4 | 3 | 2.6 |
| 7 | F-5 | 67 | 12.7 | 3 | 3 | 1.4 |
| 8 | F-11A | 65 | 12.8 | 5 | 4 | 2.0 |
| 9 | F-12 | 64 | 14.5 | 5 | 4 | 2.7 |
| 10 | F-13 | 63 | 16.3 | 4 | 7 | 1.8 |
| C12 | F-14 | 54 | 16.2 | 4 | 1 | 4.1 |
| C13 | F-7 | 52 | 14.4 | 5 | 3 | 8.6 |
| C14 | F-6 | 50 | 15.8 | 5 | 3 | 5.7 |
| C15 | F-4 | 44 | 15.1 | 3 | 4 | 4.0 |
| C16 | F-16 | 43 | 17.0 | 6 | 7 | 2.3 |
| C17 | F-17 | 0 | 17.8 | 6 | 7 | 2.6 |

[1]All receding contact angles are those of the fluorochemical alone, not the treating solution.

The data in Table 2 generally show an excellent correlation between fluorochemical receding contact angle and "walk-on" soil resistance, which means that receding contact angle was again an excellent predictor for antisoiling performance. The best anti-soiling performances on carpet (i.e., ΔE values of less than 13) were imparted by fluorochemical materials exhibiting receding contact angles of at least 65°, as compared to ΔE values of greater than 14 imparted by fluorochemical materials exhibiting receding contact angles of less than 65°. Some improvement in dynamic water repellency was evident using fluorochemical materials having higher receding contact angles.

EXAMPLES 11–22 AND COMPARATIVE EXAMPLES C19

The level (% SOF) of either fluorochemical material (F-10) or hydrocarbon material (H-1) required for optimum performance was determined using the Simulated Flex-Nip Coapplication Procedure. In these series of experiments, the aqueous acidic treating bath was adjusted to apply 0.6% SOF of stainblocking material S-1 and 1.0% SOF of $MgSO_4$ to Wolf-Laurel Nylon 6 carpet. In Comparative Example C19, no F-10 or H-1 was used. Measured carpet performance properties of soil resistance, water repellency, oil repellency, dynamic water repellency and stain resistance (the latter as measured by the Staining Test) are presented in Table 3.

TABLE 3

| Ex. | Repellent Material | % SOF | Soiling, ΔE | Water Rep. | Oil Rep. | Dyn. W. Rep. | Staining, Δa |
|---|---|---|---|---|---|---|---|
| 11 | F-10 | 0.169 | 16.0 | 3 | 4 | 1.9 | 5.1 |
| 12 | F-10 | 0.100 | 17.0 | 2 | 3 | 3.6 | 13.1 |
| 13 | F-10 | 0.068 | 16.5 | 3 | 3 | 5.4 | 4.1 |
| 14 | F-10 | 0.034 | 18.5 | 2 | 1.5 | 7.4 | 9.5 |
| 15 | F-10 | 0.017 | 20.6 | 0 | F | 12.3 | 3.0 |
| 16 | H-1 | 0.169 | 16.7 | 1 | F | 6.8 | 4.0 |
| 17 | H-1 | 0.100 | 17.6 | 1 | F | 6.8 | 5.7 |
| 28 | H-1 | 0.068 | 19.7 | 0 | F | 7.3 | 4.1 |
| 19 | H-1 | 0.034 | 20.5 | 0 | F | 10.7 | 4.5 |
| 20 | H-1 | 0.017 | 22.3 | 0 | F | 11.7 | 3.2 |
| C19 | — | — | 20.9 | F | F | 19.9 | 2.8 |

The data in Table 3 show that, not unexpectedly, as the level of fluorochemical or hydrocarbon material was lowered, overall performance was reduced. The one exception was stain resistance, which generally remained relatively constant at the constant concentration of stainblocker material used. Best overall results were achieved at a fluorochemical material level of at least 0.034% SOF and at a hydrocarbon material level of at least 0.100% SOF. Surprisingly, at high concentrations, the hydrocarbon material performed nearly comparably to the fluorochemical material as an anti-soiling treatment.

EXAMPLES 21–26 AND COMPARATIVE EXAMPLE C19

The effect on overall carpet performance of blending a fluorochemical and a hydrocarbon material was determined. Fluorochemical material F-18, hydrocarbon material H-4A, and blends thereof, were coapplied at a total level of 0.15% SOF with stainblocking material S-1 at 0.6% SOF to Wolf-Laurel nylon 6 carpet. The $MgSO_4$ level was kept at 1.0% SOF throughout the study. Results from this study are presented in Table 4.

TABLE 4

| Ex. | F-18, % (wt) | H-4A, % (wt) | Soiling, ΔE | Water Rep. | Oil Rep. | Dyn. W. Rep. | Staining, Δa |
|---|---|---|---|---|---|---|---|
| 21 | 100 | — | 15.2 | 2 | 3 | 3.2 | 4.8 |
| 22 | 75 | 25 | 15.1 | 3 | 3 | 3.9 | 2.4 |

TABLE 4-continued

| Ex. | F-18, % (wt) | H-4A, % (wt) | Soiling, ΔE | Water Rep. | Oil Rep. | Dyn. W. Rep. | Staining, Δa |
|---|---|---|---|---|---|---|---|
| 23 | 50 | 50 | 15.9 | 2 | 1 | 3.9 | 2.2 |
| 24 | 25 | 75 | 14.3 | 2 | 1 | 5.2 | 14.8 |
| 25 | 10 | 90 | 16.5 | 1 | F | 5.7 | 4.2 |
| 26 | — | 100 | 14.3 | 0 | F | 5.4 | 3.4 |
| C19 | — | — | 21.6 | F | F | 18.0 | 2.2 |

The data in Table 4 show that, as higher percentages of hydrocarbon material were incorporated in to the blend, soil resistance, stain resistance and dynamic water repellency all remained at a high level of performance, though water and oil repellency were reduced as the hydrocarbon percentage approached 90%.

EXAMPLES 27–30

In this study, the effect on overall carpet performance of hybrid fluorochemical materials having both fluorochemical and hydrocarbon moieties present in the same repellent material molecule was determined. Hybrid fluorochemical materials FH-1, FH-2, FH-3 and FH-4 were compared in performance to their non-hybrid analogues, fluorochemical material F-18 and hydrocarbon material H-4A. The various repellent materials were coapplied at a total level of 0.15% SOF with stainblocking material S-1 at 0.6% SOF to Wolf-Laurel nylon 6 carpet. The $MgSO_4$ level was kept at 1.0% SOF throughout the study. Results from this study are presented in Table 5. (Examples 21 and 26, representing 100% fluorochemical moieties and 100% hydrocarbon moieties, respectively, were included from Table 4.)

TABLE 5

| | Repellent Material: | | | | | | Dyn. | |
|---|---|---|---|---|---|---|---|---|
| Ex. | Name | % (wt) | % (wt) | Soiling, ΔE | Water Rep. | Oil Rep. | W. Rep. | Staining, Δa |
| 21 | F-18 | 100 | — | 15.2 | 2 | 3 | 3.2 | 4.8 |
| 27 | FH-1 | 79 | 21 | 13.9 | 2 | 3 | 2.6 | 1.5 |
| 28 | FH-2 | 56 | 44 | 14.9 | 2 | F | 4.4 | 1.9 |
| 29 | FH-3 | 30 | 70 | 16.1 | 1 | F | 5.5 | 5.0 |
| 30 | FH-4 | 13 | 87 | 15.9 | 1 | F | 5.3 | 1.3 |
| 26 | H-4A | — | 100 | 14.3 | 0 | F | 5.4 | 3.4 |

The data in Table 5 show similar trends to the data in Table 4, with soil resistance, stain resistance and dynamic water repellency all remaining at a high level of performance and repellency (especially to oil) diminishing with increasing hydrocarbon percentage.

EXAMPLES 31–38

The level (% SOF) of magnesium sulfate required to provide optimum performance in a flex-nip-applied coapplication formulation was determined. In each example, the Simulated Flex-Nip Coapplication Procedure was used to apply 0.15% SOF of fluorochemical material F-10 and 0.6% SOF of stainblocking material S-1 to Wolf-Laurel nylon 6 carpet, with treating solution pH adjusted to 2 using sulfamic acid. Results showing the effect of magnesium sulfate level on carpet water repellency, oil repellency, dynamic water repellency and stain resistance (the latter as measured by the Staining Test) are presented in Table 6.

TABLE 6

| Ex. | $MgSO_4$, % SOF | Water Rep. | Oil Rep. | Dyn. W. Rep. | Staining Δa |
|---|---|---|---|---|---|
| 31 | 0.05 | 0 | F | 9.0 | 3.8 |
| 32 | 0.1 | 0 | F | 7.4 | 4.7 |
| 33 | 0.2 | 0 | F | 3.3 | 4.3 |
| 34 | 0.5 | 0 | F | 5.1 | 1.6 |
| 35 | 1.0 | 3 | 4 | 1.7 | 1.4 |
| 36 | 2.0 | 2 | 4 | 3.3 | 0.9 |
| 37 | 5.0 | 2 | 2 | 4.0 | 5.1 |
| 38 | 10.0 | 2 | 4 | 4.0 | 3.4 |

The data in Table 6 show that overall performance actually peaked at a mid-range magnesium sulfate concentration (i.e., at about 1% SOF), especially dynamic water repellency and stain resistance. Under these experimental conditions, at least 1.0% SOF of $MgSO_4$ was required to provide good carpet water and oil repellency.

Figure 2:
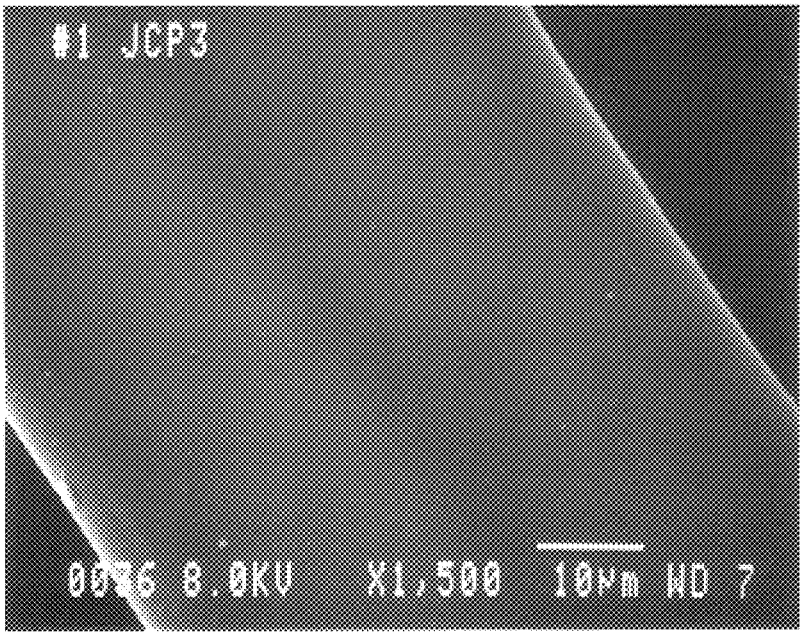
FIGS. 2–5 are micrographs of treated fibers which illustrate the effects of the concentration of magnesium salt on treatment process of the present invention.
Figure 3:
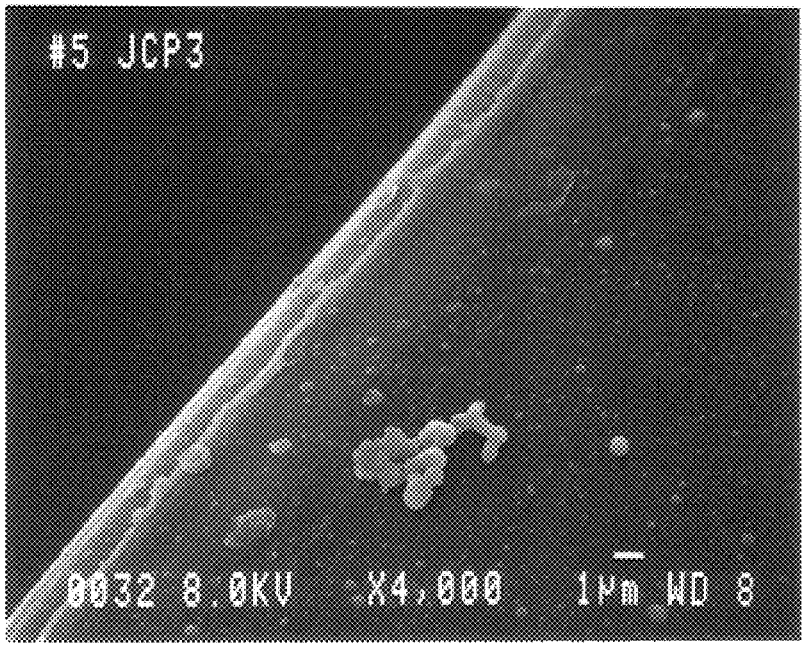
Figure 4:
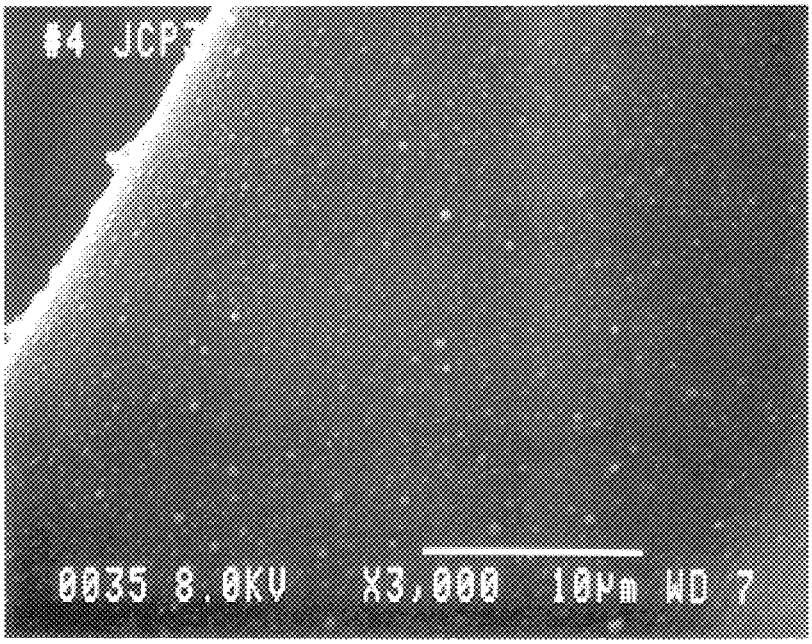

FIGS. 2–5 are micrographs which illustrate the effects of the concentration of magnesium salt on treatment process of the present invention. In FIG. 2, which corresponds to Example 31, the concentration of magnesium salt used in the treatment method is too small. Consequently, there is little or no exhaustion of the fluorochemical onto the fiber, resulting in poor water repellency and no oil repellency. In FIG. 3, on the other hand, which corresponds to Example 38, the concentration of magnesium salt is too high, resulting in coagulation of the fluorochemical. This causes a decrease in the dynamic water repellency and slightly less than optimal oil repellency. In FIG. 4, which corresponds to Example 35, the concentration of magnesium salt is optimal, resulting in even exhaustion of the fluorochemical onto the fiber surface and optimal performance characteristics.

Figure 5:
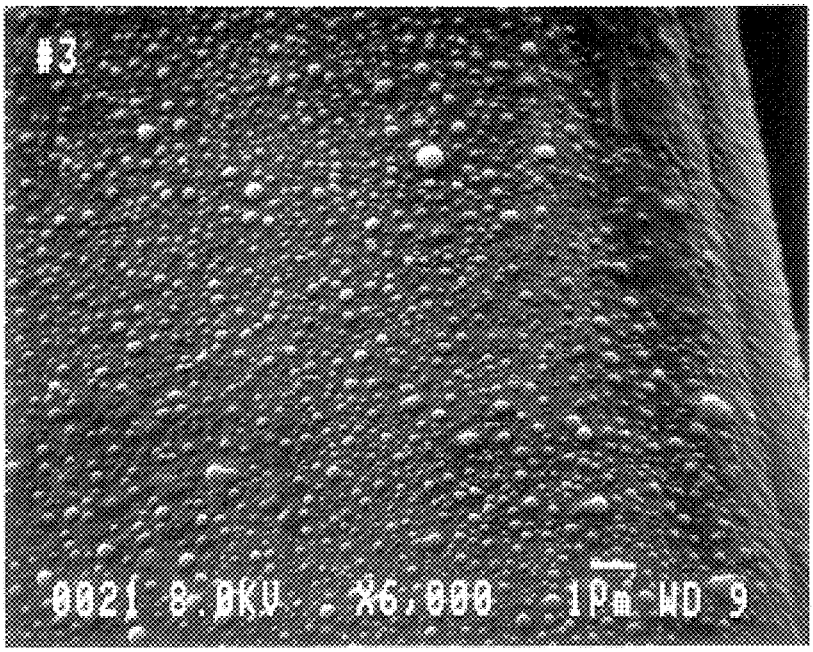

For comparison, FIG. 5 is a micrograph of a hydrocarbon (H-1) which was exhausted under conditions similar to those for Example 35. As in Example 35, an even coating of hydrocarbon was achieved on the fiber surface, and good performance characteristics were observed.

Figure 6:
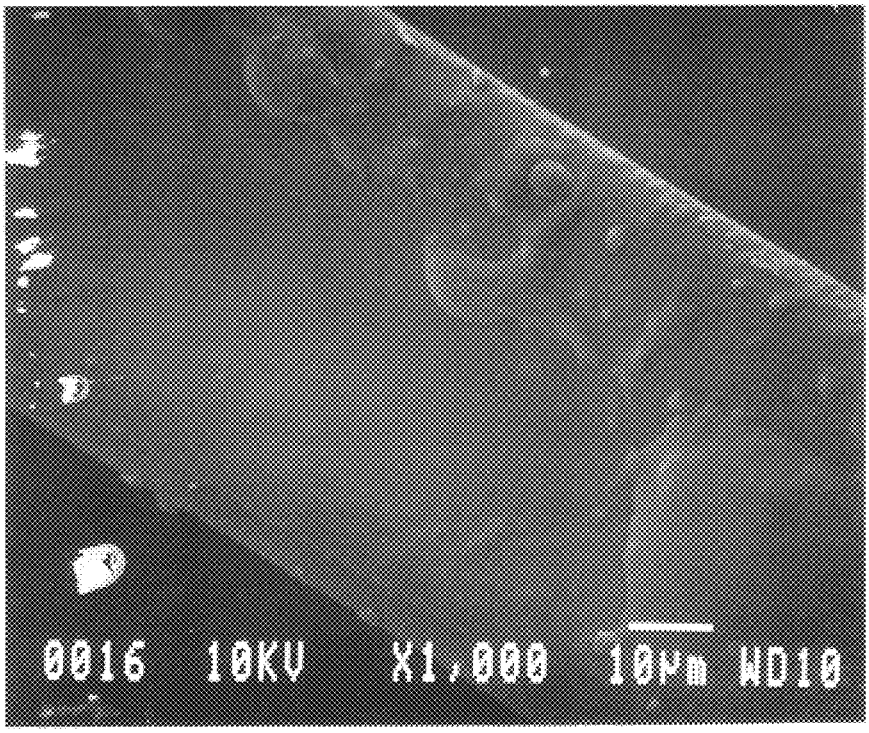
FIG. 6 is a micrograph of a carpet fiber treated by a typical spray application process.

FIG. 6 is a micrograph of a carpet treated by a typical spray application process. Upon comparison to FIGS. 4–5, it is apparent that carpet fibers treated in accordance with the method of the present invention are coated more evenly, and thus exhibit better antisoiling properties, than carpets treated by a spray application method.

EXAMPLES 39–44 AND COMPARATIVE EXAMPLES C20–C22

The pH required to provide optimum performance in flex-nip-applied fluorochemical or hydrocarbon material-containing coapplication formulations was determined in the absence of a salt. In each example, the Simulated Flex-Nip Coapplication Procedure was used to co-apply 0.15% SOF of fluorochemical material F-10 or 0.15% SOF of hydrocarbon material H-1 with 0.6% SOF of stainblocking material S-1 to Wolf-Laurel nylon 6 carpet. In Comparative Example C22, only stainblocking material was applied. The treating solution was adjusted to various pH values using sulfamic acid. Results showing the effect of pH on carpet water repellency, oil repellency, dynamic water repellency and stain resistance are presented in Table 7.

TABLE 7

| Ex. | Repellent Material | pH | Water Rep. | Oil Rep. | Dyn. W. Rep. | Staining Δa |
|---|---|---|---|---|---|---|
| C20 | F-10 | 2.12 | F | F | 17.9 | 18.5 |
| 39 | F-10 | 1.87 | F | F | 9.1 | 21.5 |
| 40 | F-10 | 1.69 | 2 | 1 | 5.2 | 6.5 |
| 41 | F-10 | 1.49 | 2 | 3 | 3.1 | 11.3 |
| C21 | H-1 | 2.18 | F | F | 20.0 | 17.3 |
| 42 | H-1 | 1.88 | F | F | 16.9 | 14.1 |
| 43 | H-1 | 1.69 | 0 | F | 10.5 | 6.6 |
| 44 | H-1 | 1.56 | 0 | F | 4.2 | 12.1 |
| C22 | — | 2.0 | F | F | 20.0 | 2.5 |

The data in Table 7 show that water repellency, oil repellency and dynamic water repellency values were optimized when the pH was set at about 1.7 or below, especially at about 1.5 or below. Poor repellency was noted when pH was greater than 2. Stainblocking performance in the presence of a repellent material peaked at a pH of about 1.7.

EXAMPLES 49–70

The pH required to provide optimum performance in flex-nip-applied fluorochemical or hydrocarbon material-containing coapplication formulations was determined in the presence of magnesium sulfate. In each example, the Simulated Flex-Nip Coapplication Procedure was used to co-apply 0.15% SOF of fluorochemical material F-10 or 0.15% SOF of hydrocarbon material H-1 with 0.6% SOF of stainblocking material S-land 1.0% SOF of $MgSO_4$ to Wolf-Laurel nylon 6 carpet. The treating solution was adjusted to various pH values using sulfamic acid. Results showing the effect of pH on carpet water repellency, oil repellency and dynamic water repellency are presented in Table 8. Also presented in Table 8 for Examples 49–59 is the parts per million of fluorine detected on each treated carpet as determined using the Fluorine Analysis Combustion Test.

TABLE 8

| Ex. | Repellent Material | pH | Water Rep. | Oil Rep. | Dyn. W. Rep. | Fluorine, ppm |
|---|---|---|---|---|---|---|
| 45 | F-10 | 3.80 | F | F | 8.8 | 151 |
| 46 | F-10 | 3.16 | F | F | 11.3 | 110 |
| 47 | F-10 | 3.10 | 1 | 1 | 6.9 | 201 |
| 48 | F-10 | 2.97 | 1 | F | 5.6 | 161 |
| 49 | F-10 | 2.66 | 2 | 3 | 4.4 | 290 |
| 50 | F-10 | 2.58 | 2 | 3 | 3.2 | 308 |
| 51 | F-10 | 2.39 | 3 | 3 | 2.8 | 288 |
| 52 | F-10 | 2.21 | 3 | 3 | 2.6 | 292 |
| 53 | F-10 | 1.92 | 3 | 3 | 2.9 | 367 |
| 54 | F-10 | 1.70 | 3 | 3 | 2.8 | 343 |
| 55 | F-10 | 1.52 | 3 | 4 | 1.6 | 358 |
| 56 | H-1 | 3.82 | F | F | 15.2 | — |
| 57 | H-1 | 3.16 | F | F | 12.3 | — |
| 58 | H-1 | 3.10 | F | F | 12.9 | — |
| 59 | H-1 | 2.93 | F | F | 10.9 | — |
| 60 | H-1 | 2.66 | 0 | F | 8.1 | — |
| 61 | H-1 | 2.58 | 0 | F | 6.9 | — |
| 62 | H-1 | 2.36 | 1 | F | 6.4 | — |
| 63 | H-1 | 2.17 | 1 | F | 4.6 | — |
| 64 | H-1 | 1.91 | 1 | F | 4.9 | — |
| 65 | H-1 | 1.72 | 1 | F | 5.5 | — |
| 66 | H-1 | 1.50 | 1 | F | 5.2 | — |

The data in Table 8 show that, when magnesium sulfate is present, urn water repellency, oil repellency and dynamic water repellency values occur for both F-10 and H-1 when the pH of the treating solution is set at about 3 or below, preferably at about 2.7 or below. For F-10, this corresponds to higher fluorine levels measured on the carpet samples treated at a pH of 2.7 or below (Examples 53–59).

The dynamic repellency behavior of Examples 39–66 are depicted graphically in FIG. 1. There, one sees that the dynamic repellency, which is a measure of the instantaneous absorption of water by the substrate, increases more slowly as a function of decreasing pH when a salt ($MgSO_4$) is used than when no salt is used. Hence, pH has a lesser effect on dynamic repellency in the process of the present invention when a salt is used. The data also indicate that, at a given pH, the presence of salt improves the dynamic repellency across the board. For materials with good repellency properties, improved dynamic repellency is indicative of improved (e.g., more uniform) application of the fluorochemical or hydrocarbon to the substrate. Hence, at a given pH, the presence of a salt improves the application of the fluorochemical or hydrocarbon to the substrate. For fluorochemicals or hydrocarbons having good antisoiling properties, the improvement in application to the substrate would be expected to impart better antisoiling properties.

EXAMPLES 67–72

The level (% SOF) of stainblocking material required to provide optimum performance in a flex-nip-applied coapplication formulation was determined. In each example, the Simulated Flex-Nip Coapplication Procedure was used to apply the designated % SOF of stainblocking material S-1, 0.15% SOF of fluorochemical material F-10 and 1.0% SOF of $MgSO_4$ to Wolf-Laurel nylon 6 carpet, with treating solution pH adjusted to 2 using sulfamic acid. Results showing the effect of stainblocking material level on carpet water repellency, oil repellency, dynamic water repellency and stain resistance on carpet are presented in Table 9.

TABLE 9

| Ex. | S-1 % SOF | Water Rep. | Oil Rep. | Dyn. W. Rep. | Staining Δa |
|---|---|---|---|---|---|
| 67 | 0.15 | 3 | 4 | 2.3 | 48.1 |
| 68 | 0.3 | 3 | 4 | 2.0 | 45.9 |
| 69 | 0.6 | 2 | 2 | 2.4 | 27.6 |
| 70 | 0.75 | 3 | 3 | 2.7 | 13.7 |
| 71 | 0.9 | 3 | 4 | 3.4 | 9.4 |
| 72 | 1.5 | 2 | 2 | 5.5 | 8.4 |

The data in Table 9 show that, as expected, resistance to staining was improved by using higher levels of stainblocking material. Repellency performance was basically unaffected by the level of stainblocker used within the concentration range studied.

EXAMPLES 73–74 AND COMPARATIVE EXAMPLES C23–C26

A study was run comparing overall performance of coapplication systems containing fluorochemical materials and hydrocarbon materials both inside (F-10 and H-1) and outside (F-7, F-11A, F-19 and H-19) of this invention. In each example, the Simulated Flex-Nip Coapplication Procedure was used to apply 0.15% SOF of the designated fluorochemical material and 0.68% SOF of stainblocking material S-1 to nylon 6 Wolf-Laurel carpet from an aqueous treating solution having the pH adjusted to about 1.5 with sulfamic acid. Results showing the effect of repellent material level on carpet soiling, water repellency, oil repellency, dynamic water repellency and staining are presented in Table 10.

TABLE 10

| Ex. | Repellent Material | Rec. Cont. Angle (°) | Soiling, ΔE | Water Rep. | Oil Rep. | Dyn. W. Rep. | Staining, Δa |
|---|---|---|---|---|---|---|---|
| 73 | F-10 | 75 | 10.4 | 2 | 2 | 1.1 | 20.0 |
| C23 | F-11A | 65 | 12.3 | 3 | 3 | 2.5 | 16.4 |
| C24 | F-7 | 52 | 12.2 | 2 | 3 | 8.4 | 20.4 |
| C25 | F-19 | 12 | 17.0 | 5 | 5 | 2.4 | 20.4 |
| 74 | H-1 | 40 | 15.0 | 1 | F | 4.4 | 15.1 |
| C26 | H-19 | 0 | 20.2 | 1 | F | 5.7 | 20.2 |

The data in Table 10 show that, of the fluorochemical materials, F-10 and F-11A exhibited the best combination of anti-soiling, water repellency, oil repellency, dynamic water repellency and stain resistance. However, F-10 is clearly superior to F-11A in anti-soiling performance as would be predicted by its higher receding contact angle, and is also superior in most other categories. Similarly, hydrocarbon material H-1, which has a higher receding contact angle than hydrocarbon material H-19, also exhibits superior anti-soiling characteristics compared to H-19.

EXAMPLES 75–118 AND COMPARATIVE EXAMPLE C27

Using the Simulated Flex-Nip Coapplication Procedure, a number of salts were evaluated in coapplication systems containing fluorochemical material F-10 at 0.25% SOF and stainblocking material S-1 material at 0.6% SOF on Upbeat™ nylon carpet. Monovalent cation salts were examined in Examples 75–100, divalent cation salts were evaluated in Examples 101–115, and trivalent cation salts were evaluated in Examples 116–118; no salt was used in Comparative Example C27. Concentrations of salts used are expressed as % SOF on the carpet. Results showing the effect of salt selection and level on carpet water repellency, oil repellency, dynamic water repellency and stain resistance are presented in Table 11.

TABLE 11

| | Metal Salt: | | | | | Dyn. | |
|---|---|---|---|---|---|---|---|
| Ex. | Name | Cat. Val. | % SOF | Water Rep. | Oil Rep. | W. Rep. | Staining (Δa) |
| 75 | LiCl | +1 | 0.13 | 2 | 0 | 3.5 | 1.7 |
| 76 | LiCl | +1 | 0.66 | 3 | 3 | 0.8 | 0.7 |
| 77 | $Li_2SO_4$ | +1 | 0.17 | F | 0 | 8.6 | 17.4 |
| 78 | $Li_2SO_4$ | +1 | 0.86 | 2 | 2 | 1.3 | 2.7 |
| 79 | NaCl | +1 | 0.18 | 2 | 1 | 4.1 | 4.6 |
| 80 | NaCl | +1 | 0.36 | 3 | 3 | 1.0 | 3.0 |
| 81 | NaCl | +1 | 0.91 | 3 | 4 | 1.1 | 1.6 |
| 82 | NaCl | +1 | 1.81 | 3 | 3 | 1.2 | 2.5 |
| 83 | NaBr | +1 | 0.32 | 2 | 0 | 3.7 | 3.2 |
| 84 | NaBr | +1 | 1.60 | 3 | 2 | 0.8 | 1.4 |
| 85 | NaI | +1 | 0.47 | 2 | 0 | 4.3 | 6.9 |
| 86 | NaI | +1 | 2.35 | 2 | 2 | 1.0 | 2.1 |
| 87 | $Na_2SO_4$ | +1 | 0.22 | 0 | 0 | 5.7 | 6.4 |
| 88 | $Na_2SO_4$ | +1 | 0.45 | 2 | 3 | 2.7 | 3.8 |
| 89 | $Na_2SO_4$ | +1 | 1.11 | 3 | 4 | 0.9 | 3.9 |
| 90 | $Na_2SO_4$ | +1 | 2.22 | 3 | 3 | 1.1 | 2.7 |
| 91 | KCl | +1 | 0.23 | 2 | 2 | 3.2 | 1.3 |
| 92 | KCl | +1 | 1.17 | 2 | 4 | 0.7 | 0.9 |
| 93 | CsCl | +1 | 0.53 | 2 | 1 | 3.2 | 1.8 |
| 94 | CsCl | +1 | 2.63 | 3 | 4 | 1.0 | 0.6 |
| 95 | $NH_4Cl$ | +1 | 0.17 | 2 | 0 | 3.5 | 2.9 |
| 96 | $NH_4Cl$ | +1 | 0.83 | 2 | 1 | 1.0 | 1.6 |
| 97 | $(NH_4)_2SO_4$ | +1 | 0.21 | 0 | 0 | 7.6 | 10.1 |
| 98 | $(NH_4)_2SO_4$ | +1 | 1.03 | 3 | 3 | 1.3 | 2.6 |
| 99 | $(CH_3)_4NCl$ | +1 | 0.34 | 1 | 0 | 5.9 | 15.5 |

TABLE 11-continued

| | Metal Salt: | | | | | Dyn. | |
|---|---|---|---|---|---|---|---|
| Ex. | Name | Cat. Val. | % SOF | Water Rep. | Oil Rep. | W. Rep. | Staining (Δa) |
| 100 | $(CH_3)_4NCl$ | +1 | 1.70 | 3 | 3 | 0.5 | 2.6 |
| 101 | $MgCl_2$ | +2 | 0.13 | 3 | 3 | 1.3 | 3.4 |
| 102 | $MgCl_2$ | +2 | 0.32 | 3 | 4 | 0.8 | 1.1 |
| 103 | $MgCl_2$ | +2 | 0.63 | 3 | 3 | 0.9 | 1.8 |
| 104 | $MgCl_2$ | +2 | 1.27 | 3 | 3 | 1.6 | 2.0 |
| 105 | $MgSO_4$ | +2 | 0.08 | 3 | 3 | 2.3 | 3.5 |
| 106 | $MgSO_4$ | +2 | 0.19 | 3 | 3 | 0.7 | 2.2 |
| 107 | $MgSO_4$ | +2 | 0.38 | 4 | 3 | 1.0 | 2.2 |
| 108 | $MgSO_4$ | +2 | 0.75 | 3 | 3 | 1.2 | 2.5 |
| 109 | $CaCl_2$ | +2 | 0.45 | 3 | 3 | 0.6 | 1.9 |
| 110 | $SrCl_2$ | +2 | 0.83 | 3 | 3 | 0.9 | 1.2 |
| 111 | $BaCl_2$ | +2 | 0.76 | 3 | 4 | 0.6 | 1.8 |
| 112 | $ZnCl_2$ | +2 | 0.43 | 3 | 3 | 0.9 | 1.3 |
| 113 | $ZnSO_4$ | +2 | 0.90 | 2 | 2 | 1.5 | 1.6 |
| 114 | $FeSO_4$ | +2 | 0.87 | 2 | 3 | 3.0 | 10.5 |
| 115 | $CuSO_4$ | +2 | 0.78 | 2 | 1 | 3.6 | 4.9 |
| 116 | $Al(NO_3)_3$ | +3 | 0.004 | F | 0 | 11.1 | 7.1 |
| 117 | $Al(NO_3)_3$ | +3 | 0.04 | 1 | 1 | 4.5 | 25.3 |
| 118 | $Al(NO_3)_3$ | +3 | 0.39 | 0 | 0 | 5.5 | 20.3 |
| C27 | — | — | — | F | 0 | 13.6 | 10.2 |

The data in Table 11 show that both divalent and monovalent cation metal salts enhanced all the physical properties of the treated carpet as compared to when no salt was used (Comparative Example C27). Monovalent cation metal salts performed well at levels varying from about 0.25 to about 2.5% SOF, while divalent cation metal salts performed even more efficiently, working at levels varying from less than 0.1% to 1.27% SOF (the highest level evaluated).

EXAMPLES 119–123 AND COMPARATIVE EXAMPLES C28–C44

Using the Spray Application and Curing Procedure, 0.25% SOF each of several hydrocarbon materials were spray applied to samples of Style M0678 nylon carpet previously treated with 0.84% SOF of S-1 Stainblocking Material and 0.5% SOF of $MgSO_4$ using the Simulated Flex-Nip Coapplication Procedure, with pH adjusted to 1.5 using 1.5% aqueous sulfamic acid. Resistance to soiling of the treated carpet samples compared to unsoiled, untrafficked carpet samples was determined using two cycles of the "Walk-On" Soiling Test. A tabulation comparing "walk-on" soiling and receding contact angle (RCA) for the various hydrocarbon materials is presented in Table 13.

TABLE 13

| Ex. | Hydrocarbon | RCA (°) | Soiling, ΔE |
|---|---|---|---|
| 119 | H-1 | 45 | 4.2 |
| 120 | H-3 | 45 | 4.8 |
| 121 | H-10 | 40 | 5.5 |
| 122 | H-10A | 40 | 6.4 |
| 123 | H-2 | 40 | 9.5 |
| C28 | H-15 | 10 | 8.2 |
| C29 | H-18 | 0 | 8.4 |
| C30 | H-12 | 0 | 9.1 |
| C31 | H-19 | 0 | 9.3 |
| C32 | H-14 | 0 | 9.4 |
| C33 | H-4 | 0 | 9.6 |
| C34 | H-7 | 0 | 9.8 |
| C35 | H-5 | 0 | 10.0 |
| C36 | H-6 | 0 | 10.0 |
| C37 | H-11 | 0 | 10.4 |
| C38 | H-16 | 0 | 11.0 |
| C39 | H-13 | 0 | 11.2 |

TABLE 13-continued

| Ex. | Hydrocarbon | RCA (°) | Soiling, ΔE |
|---|---|---|---|
| C40 | H-8 | 0 | 11.5 |
| C41 | H-17 | 0 | 12.2 |
| C42 | H-20 | 0 | 12.3 |
| C43 | H-21 | 0 | 14.3 |
| C44 | H-9 | 0 | 19.1 |

The data in Table 13 show an excellent correlation between hydrocarbon receding contact angle and "walk-on" soil resistance, similar to what was noted with the immersion-applied hydrocarbon material listed in Table 1. With the exception of Hydrocarbon Material H-2, the hydrocarbon materials exhibiting the highest receding contact angles demonstrated the best anti-soiling performance on carpet (i.e., showed the lowest ΔE values when compared to untreated, unsoiled carpet). Overall, very few hydrocarbon materials exhibited good receding contact angles and resultant good anti-soiling performance.

EXAMPLES 123–128 AND COMPARATIVE EXAMPLES C52–C55

Using the Simulated Flex-Nip Coapplication Procedure, fluorochemical materials F-10 and F-19, stainblocking material S-1 and magnesium sulfate were coapplied to Chesapeake Bay™ polypropylene (PP) and Venus™ polyester (PE) carpets using a treating solution with the pH adjusted to about 2 with sulfamic acid. For each fluorochemical material, a theoretical level of 500 ppm fluorine was applied to the carpet. In some examples, either the S-1 or the $MgSO_4$ was omitted. A very low level of S-1 (0.073% SOF) was used as the carpets inherently had good stain resistance, although the low level of S-1 served to stabilize the water emulsion. Treated carpet samples were tested for water repellency, oil repellency and dynamic water repellency, with the results presented in Table 14.

TABLE 14

| Ex. | Carpet | Fluor. Mat. | S-1, % SOF | $MgSO_4$, % SOF | Water Rep. | Oil Rep. | Dyn. W. Rep. |
|---|---|---|---|---|---|---|---|
| 123 | PP | F-10 | 0.073 | 0.50 | 3 | 4 | 1.4 |
| C52 | PP | F-19 | 0.073 | 0.50 | 1 | F | 3.8 |
| 124 | PP | F-10 | — | 0.17 | 3 | 4 | 2.5 |
| C53 | PP | F-19 | — | 0.17 | 1 | F | 3.9 |
| 125 | PP | F-10 | 0.073 | — | 2 | 1 | 3.4 |
| 126 | PE | F-10 | 0.073 | 0.50 | 2 | 1 | 1.6 |
| C54 | PE | F-19 | 0.073 | 0.50 | 2 | F | 5.4 |
| 127 | PE | F-10 | — | 0.17 | 2 | 2 | 0.8 |
| C55 | PE | F-19 | — | 0.17 | 1 | F | 3.6 |
| 128 | PE | F-10 | 0.073 | — | 0 | F | 11.9 |

The data in Table 14 show that, in all cases, repellency values were better with fluorochemical material F-10 (receding contact angle of 76°) than with fluorochemical material F-19 (receding contact angle of 12°). For the polypropylene carpet, best results were attained using a combination of F-10, stainblocking material and magnesium sulfate. For the polyester carpet, only the magnesium sulfate was required with F-10 to give good results.

COMPARATIVE EXAMPLE C56 AND EXAMPLES 129–134

This series of experiments was run to illustrate anti-soiling synergism displayed between an immersion-applied hydrocarbon material and a subsequently spray-applied fluorochemical material.

For Examples 129–134, the Simulated Flex-Nip Coapplication Procedure was used to coapply to UPBEA™ nylon 6 carpet a mixture of hydrocarbon material H-1 at either 1.0 or 0.5% SOF, stainblocking material S-1 at 0.6% SOF and magnesium sulfate at 1% SOF from a treating solution with pH adjusted to about 2 with sulfamic acid. Then, using the Spray Application and Curing Procedure, fluorochemical material F-8 was spray applied to the hydrocarbon material-treated carpet at theoretical fluorine level of either 250 or 500 ppm. Then the treated carpet was subjected to one cycle of the "Walk-On" Soiling Test.

In Comparative Example C56, the carpet was untreated.

In Comparative Example C57, no fluorochemical material was spray applied to the carpet.

Carpet samples were subjected to one cycle of the "Walk-On" Soiling Test and were also tested using the Dynamic Water Repellency Test, with results shown in Table 15.

TABLE 15

| Ex. | H-1, % SOF | F-8 ppm | Soiling, ΔE: | Dyn. Wat. Repellency |
|---|---|---|---|---|
| C56 | — | — | 7.5 | 7.9 |
| 129 | 1.0 | — | 4.1 | 1.3 |
| 130 | 0.5 | — | N/R* | 1.6 |
| C57 | — | 500 | 2.6 | N/R* |
| 131 | 1.0 | 500 | 1.2 | 2.7 |
| 132 | 1.0 | 250 | 1.6 | N/R* |
| 133 | 0.5 | 500 | 1.2 | 1.2** |
| 134 | 0.5 | 250 | 1.6 | N/R* |

*N/R means not run
**F-8 used at 325 ppm

By comparing the soiling value in Table 15 for Example 134 against the soiling values for Example 129 and Comparative Example C57, a synergistic anti-soiling effect is evident between hydrocarbon material H-1 and fluorochemical material F-8.

What is claimed is:

1. A fluorine-free material having at least one pendant hydrocarbon moiety, said material being the product of a condensation reaction between a biuret isocyanate trimer and an alcohol having at least 10 carbon atoms;

wherein said material has a receding contact angle to n-hexadecane of at least about 35° and a glass transition temperature within the range of about 20° C. to about 130° C., and wherein the trimer and the alcohol are reacted at a ratio of at least about 3 moles of alcohol per mole of trimer.

2. A fluorine-free material having at least one pendant hydrocarbon moiety, said material being formed by reacting a biuret isocyanate trimer with an alcohol having at least 10 carbon atoms, wherein the trimer and the alcohol are reacted at a ratio of at least about 3 moles of alcohol per mole of trimer.

3. The material of claim 2, wherein said alcohol has 12 to 24 carbon atoms.

4. The material of claim 2, wherein said alcohol is stearyl alcohol.

5. The material of claim 2, wherein said alcohol has 12 carbon atoms.

6. The material of claim 2, wherein said alcohol has 14 carbon atoms.

7. The material of claim 2, wherein said alcohol has 16 carbon atoms.

8. The material of claim 2, wherein said alcohol is a straight chain alcohol.

9. The material of claim 2, wherein the material is formed by reacting said biuret isocyanate trimer with about 3 moles equivalent of said alcohol.

10. The material of claim 2, wherein the material is formed by reacting said biuret isocyanate trimer with greater than 3 moles equivalent of said alcohol.

11. The material of claim 2, wherein said material is non-cationic.

12. The material of claim 2, wherein said material has a receding contact angle to n-hexadecane of at least about 35°.

13. The material of claim 2, wherein said material has a glass transition temperature within the range of about 20° C. to about 130° C.

14. The material of claim 2, in combination with a fibrous substrate.

15. The material of claim 14, wherein said fibrous substrate is carpeting.

16. The material of claim 1, wherein the material is formed by reacting said biuret isocyanate trimer with greater than 3 moles equivalent of said alcohol.

17. The material of claim 1, wherein said material is non-cationic.

18. The material of claim 1, wherein said alcohol has 12 to 24 carbon atoms.

19. The material of claim 1, wherein said alcohol is stearyl alcohol.

20. The material of claim 1, wherein said alcohol is a straight chain alcohol.

* * * * *

UNITED STATES PATENT AND TRADEMARK OFFICE

CERTIFICATE OF CORRECTION

PATENT NO. : 6,613,862 B2
DATED : September 2, 2003
INVENTOR(S) : Clark, John C.

It is certified that error appears in the above-identified patent and that said Letters Patent is hereby corrected as shown below:

Column 1,
Line 34, delete "a-substituted" and insert -- α-substituted --, therefor.

Column 7,
Line 1, delete "(+wt)" and insert -- (wt) --, therefor.
Line 15, delete "Zonylm" and insert -- Zonyl™ --, therefor.
Line 31, after "Canada" insert -- . --.
Line 36, after "N-75" insert -- . --.
Line 48, delete "$cm^{-4}$" and insert -- $cm^{-1}$ --, therefor.
Line 59, after "Corp." insert -- , --.
Line 64, delete "VVR" and insert -- VWR --, therefor.

Column 9,
Line 65, delete "triisocyante" and insert -- triisocyanate --, therefor.
Line 66, delete "Huls" and insert -- Hüls --, therefor.

Column 11,
Line 3, delete "Next." and insert -- Next, --, therefor.
Line 12, delete "conmnercially" and insert -- commercially --, therefor.

Column 12,
Line 40, delete "." and insert -- , --, therefor.

Column 13,
Lie 67, after "(0.9 $kg/m^2$)" insert -- . --.

Column 14,
Line 6, after "76113" insert -- . --.
Line 8, after "Mexico" insert -- . --.
Line 21, delete "Centrifuigal" and insert -- Centrifugal --, therefor.

Column 15,
Line 21, after "suitable" delete "." and insert -- , --, therefor.
Line 42, delete "Floorcoverings" and insert -- floor-coverings --, therefor.

Column 16,
Line 58, delete "tristimulus" and insert -- tri-stimulus --, therefor.
Line 59, delete "autochromatically" and insert -- auto-chromatically -- therefor.

Column 17,
Line 7, delete "." and insert -- , --, therefor.
Line 23, delete "Chroma Meter" and insert -- Chroma Meter™ --, therefor.

UNITED STATES PATENT AND TRADEMARK OFFICE

CERTIFICATE OF CORRECTION

PATENT NO. : 6,613,862 B2
DATED : September 2, 2003
INVENTOR(S) : Clark, John C.

It is certified that error appears in the above-identified patent and that said Letters Patent is hereby corrected as shown below:

Column 17 (cont'd),
Line 27, delete "□E $[(□L^*)^2 + (□a^*)^2 + (□b^*)^2]^{1/2}$" and insert -- □E = $[(□L^*)^2 + (□a^*)^2 + (□b^*)^2]^{1/2}$ -- therefor.

Column 18,
Line 30, delete "1.20." and insert -- 1.2°. --, therefor.

Column 19,
Line 31, delete "using-the" and insert -- using the --, therefor.

Column 22,
Line 4, Table 6, Column 7 heading, after "Staining" insert -- , --.

Column 23,
Line 3, Table 7, Column 7 heading, after "Staining" insert -- , --.
Line 29, delete "S-1and" and insert -- S-1 and --, therefor.
Line 62, delete "urn" and insert -- optimum --, therefor.

Column 24,
Line 36, Table 9, Column 6 heading, after "Staining" insert -- , --.

Column 26,
Line 21, delete "25.3" and insert -- 5.3 --, therefor.
Line 39, delete "M0678" and insert -- MO678 --, therefor.

Column 28,
Line 2, delete "UPBEA™" and insert -- UPBEAT™ --, therefor.

Signed and Sealed this

Nineteenth Day of October, 2004

JON W. DUDAS
*Director of the United States Patent and Trademark Office*